US009988585B2

(12) United States Patent
Hayasaka et al.

(10) Patent No.: US 9,988,585 B2
(45) **Date of Patent: *Jun. 5, 2018**

(54) METHOD FOR PRODUCING BASE OIL FOR LUBRICANT OILS

(71) Applicant: JX NIPPON OIL & ENERGY CORPORATION, Tokyo (JP)

(72) Inventors: Kazuaki Hayasaka, Tokyo (JP); Yoshiyuki Nagayasu, Tokyo (JP); Marie Iwama, Tokyo (JP); Mayumi Yokoi, Tokyo (JP); Tomohisa Hirano, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/766,839

(22) PCT Filed: Nov. 5, 2013

(86) PCT No.: PCT/JP2013/079913

§ 371 (c)(1),
(2) Date: Aug. 10, 2015

(87) PCT Pub. No.: WO2014/125683

PCT Pub. Date: Aug. 21, 2014

(65) Prior Publication Data

US 2015/0368569 A1 Dec. 24, 2015

(30) Foreign Application Priority Data

Feb. 13, 2013 (JP) ..... 2013-026059

(51) Int. Cl.
*C10G 47/00* (2006.01)
*C10G 69/02* (2006.01)
(Continued)

(52) U.S. Cl.
CPC ..... *C10G 69/02* (2013.01); *C10G 45/58* (2013.01); *C10G 45/62* (2013.01); *C10G 45/64* (2013.01);
(Continued)

(58) Field of Classification Search
CPC ..... C10G 45/58; C10G 45/62; C10G 45/64; C10G 47/00; C10G 47/12; C10G 65/12;
(Continued)

(56) References Cited

U.S. PATENT DOCUMENTS 5,252,527 A * 10/1993 Zones ..... B01J 29/70 423/328.2
5,462,650 A * 10/1995 Takito ..... C10G 65/12 208/27
(Continued)

FOREIGN PATENT DOCUMENTS

JP H10-510535 A 10/1998
JP H10-510565 A 10/1998
(Continued)

OTHER PUBLICATIONS

Surinder Parkash, Refining Processes Handbook, Chapter 3 Hydrocracking Processes, pp. 62-108 (2003).*
(Continued)

*Primary Examiner* — Prem C Singh
*Assistant Examiner* — Brandi M Doyle
(74) *Attorney, Agent, or Firm* — Greenblum & Bernstein, P.L.C.

(57) ABSTRACT

A method for producing a base oil for lubricant oils comprising: a first step of hydrocracking a stock oil having a content percentage of a heavy matter of 80% by mass or more so that a crack per mass of the heavy matter is 20 to 85% by mass, to obtain a hydrocracked oil comprising the heavy matter and a hydrocracked product thereof, a second
(Continued)

step of fractionating the hydrocracked oil into a base oil fraction comprising the hydrocracked product and a heavy fraction comprising the heavy matter and being heavier than the base oil fraction, respectively, a third step of isomerization dewaxing the base oil fraction from the fractionation in the second step to obtain a dewaxed oil, wherein the heavy fraction from the fractionation in the second step is returned to the first step as a part of the stock oil.

8 Claims, 1 Drawing Sheet

(51) Int. Cl.

| | |
|---|---|
| ***C10G 45/64*** | (2006.01) |
| ***C10G 47/12*** | (2006.01) |
| ***C10G 65/12*** | (2006.01) |
| ***C10M 177/00*** | (2006.01) |
| ***C10M 101/02*** | (2006.01) |
| ***C10G 45/58*** | (2006.01) |
| ***C10G 45/62*** | (2006.01) |

(52) U.S. Cl.
CPC ..... *C10G 47/00* (2013.01); *C10G 47/12* (2013.01); *C10G 65/12* (2013.01); *C10M 101/02* (2013.01); *C10M 177/00* (2013.01); *C10G 2400/10* (2013.01); *C10M 2203/1006* (2013.01)

(58) Field of Classification Search
CPC .. C10G 69/02; C10G 2400/10; C10M 177/00; C10M 101/02; C10M 2203/1006
See application file for complete search history.

(56) References Cited

U.S. PATENT DOCUMENTS

| | | | | |
|---|---|---|---|---|
| 6,103,101 | A * | 8/2000 | Fragelli | B01J 27/188 208/27 |
| 6,337,010 | B1 * | 1/2002 | Hofer | C10G 65/12 208/18 |
| 2004/0045868 | A1 * | 3/2004 | Germaine | C10G 2/30 208/58 |
| 2006/0065575 | A1 | 3/2006 | Bernard et al. | |
| 2012/0114553 | A1 * | 5/2012 | Zones | C01B 39/48 423/706 |

FOREIGN PATENT DOCUMENTS

| | | | |
|---|---|---|---|
| JP | 2004-528426 | A | 9/2004 |
| JP | 2006-502297 | A | 1/2006 |
| JP | 2006-509090 | A | 3/2006 |
| WO | 02/070629 | A1 | 9/2002 |
| WO | 2011/001914 | A1 | 1/2011 |

OTHER PUBLICATIONS

Zones, Synthesis of pentasil zeolites from sodium silicate solutions in the presence of quaternary imidazole compounds, Zeolites vol. 9, p. 458-467 (Nov. 1989).*
International Search Report issued with respect to application No. PCT/JP2013/079913, dated Feb. 4, 2014.
International Preliminary Report on Patentability issued with respect to application No. PCT/JP2013/079913, dated Aug. 27, 2014.

* cited by examiner

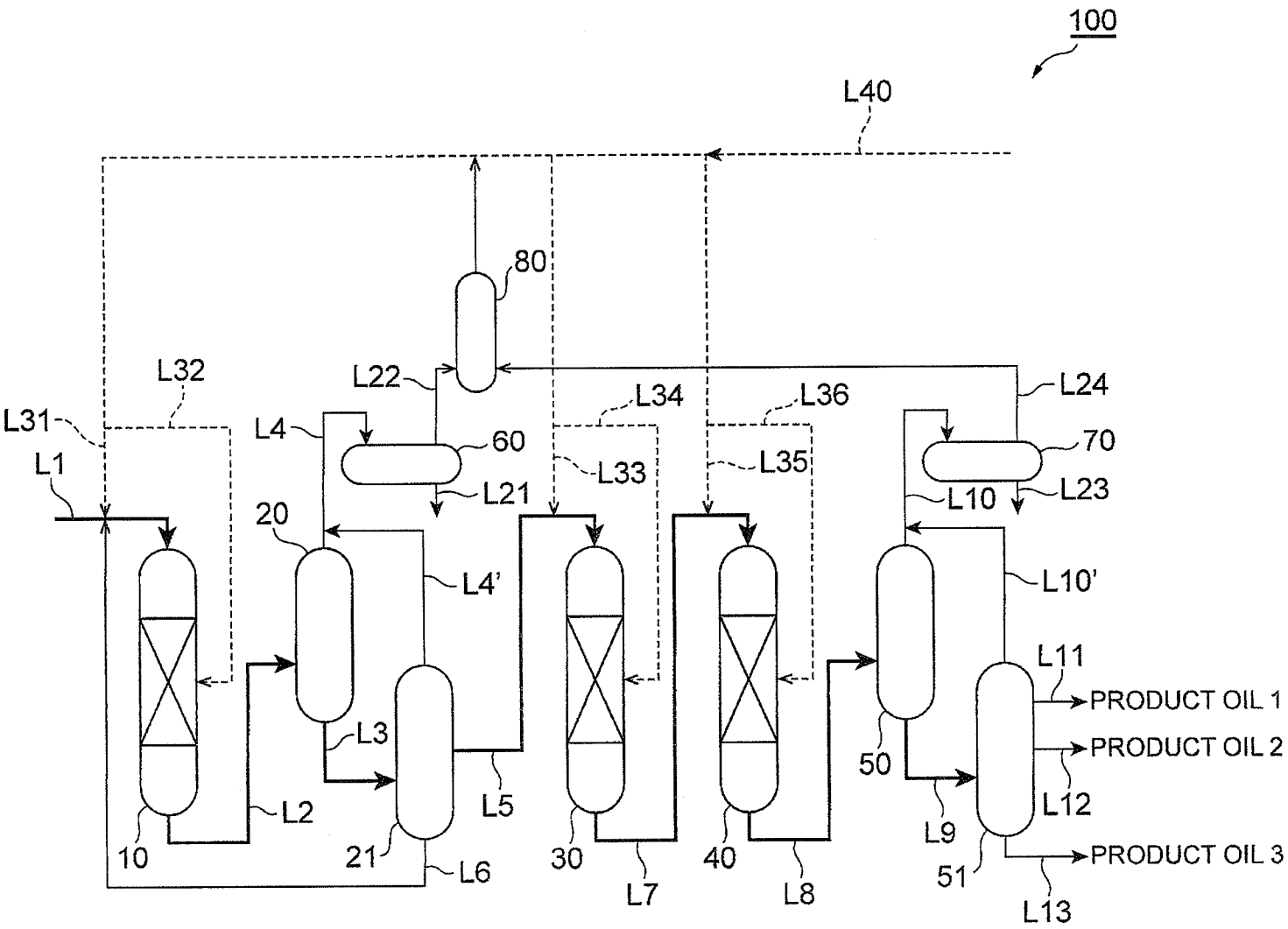
100
L40
L24
70
L23
L10'
L11
PRODUCT OIL 1
PRODUCT OIL 2
L12
PRODUCT OIL 3
L13
L10
L9
51
50
L36
L35
L8
40
L34
L33
L7
30
80
60
L21
L4'
L5
L6
L22
L3
21
L4
20
L2
L32
10
L31
L1

METHOD FOR PRODUCING BASE OIL FOR LUBRICANT OILS

TECHNICAL FIELD

The present invention relates to a method for producing a base oil for lubricant oils.

BACKGROUND ART

In the petroleum products, lubricating oils, for example, are the products with the importance weighed on the flowability at a low temperature. For this reason, a base oil used for these products desirably has a wax component such as a normal paraffin, or the like, which causes the aggravation of the low temperature flowability, being completely or partially removed, or converted to a different component from a wax component.

A known dewaxing technique for removing a wax component from a hydrocarbon oil is, for example, a method in which a wax component is extracted using a solvent such as liquid propane, MEK, or the like. However, this method poses a problem of high operating costs.

On the other hand, a known dewaxing technique for converting a wax component in a hydrocarbon oil to a non-wax component is, for example, an isomerization dewaxing in which a hydrocarbon oil is, in the presence of hydrogen, allowed to contact a hydroisomerization dewaxing catalyst having dual functions of hydrogenation-dehydration ability and isomerization ability to isomerize a normal paraffin in the hydrocarbon oil to an isoparaffin (e.g., Patent Literature 1).

CITATION LIST

Patent Literature

Patent Literature 1: National Publication of International Publication Application No. 2006-502297

SUMMARY OF INVENTION

Technical Problem

Several kinds of the base oil for lubricant oil products are available depending on purpose of use, and the low temperature performance and viscometric properties required vary in each product so that it is desirable to obtain as many as fractions corresponding to the intended products.

Thus, when a stock oil containing a fraction heavier (heavy fraction) than a fraction corresponding to the intended product (product fraction) is used for the production of a base oil for lubricant oils, a method is known in which the stock oil is hydrocracked to convert the heavy matter to the light matter before performing the isomerization dewaxing described above.

An object of the present invention is to provide a method for producing a base oil for lubricant oils capable of efficiently providing a base oil for lubricant oils having good viscometric properties from a stock oil containing a heavy matter having 30 or more carbon atoms and also, in some cases, containing sulfur and nitrogen.

Solution to Problem

The present invention relates to a method for producing a base oil for lubricant oils comprising: a first step of hydrocracking a stock oil having a content percentage of a heavy matter having 30 or more carbon atoms of 80% by mass or more under a condition of a partial pressure of hydrogen of 5 to 20 MPa so that a crack per mass of the heavy matter is 20 to 85% by mass to obtain a hydrocracked oil comprising the heavy matter and a hydrocracked product thereof, a second step of fractionating the hydrocracked oil into a base oil fraction comprising the hydrocracked product and a heavy fraction comprising the heavy matter and being heavier than the base oil fraction, and a third step of isomerization dewaxing the base oil fraction from the fractionation in the second step to obtain a dewaxed oil, wherein the heavy fraction from the fractionation in the second step is returned to the first step as a part of the stock oil.

In an aspect of the present invention, the content percentage of sulfur in the above stock oil may be 0.0001 to 3.0% by mass.

In an aspect of the present invention, the method for producing a base oil for lubricant oils may further comprise a fourth step of obtaining a hydrorefined oil by hydrorefining the dewaxed oil obtained in the third step, and a fifth step of obtaining a base oil for lubricant oils by fractionating the hydrorefined oil obtained in the fourth step.

In the above aspect, it is preferred to obtain a base oil for lubricant oils in the fifth step which has a kinematic viscosity at 100° C. of 3.5 $mm^2/s$ or more and 4.5 $mm^2/s$ or less and a viscosity index of 120 or more.

In an aspect of the present invention, the stock oil may contain a slack wax having a 10% by volume distillation temperature of 500 to 600° C. and a 90% by volume distillation temperature of 600 to 700° C., and at which the hydrocracking is preferably carried out so that a crack per mass of the above heavy matter in the first step is 25 to 85% by mass.

Further, in an aspect, the stock oil may contain a slack wax having a 10% by volume distillation temperature of 400 to 500° C. and a 90% by volume distillation temperature of 500 to 600° C., and the hydrocracking is carried out so that a crack per mass of the heavy fraction in the first step is 20 to 80% by mass.

In an aspect of the present invention, the hydrocracking can be carried out, in the presence of hydrogen, by allowing the stock oil to contact a hydrocracking catalyst containing a porous inorganic oxide composed of 2 or more elements selected from aluminium, silicon, zirconium, boron, titanium and magnesium and at least 1 metal selected from the elements belonging to the Group 6 and the Groups 8 to 10 in the periodic table supported on the porous inorganic oxide.

In an aspect of the present invention, the third step may be a step of obtaining the dewaxed oil by allowing the base oil fraction to contact a hydroisomerization dewaxing catalyst, wherein the hydroisomerization dewaxing catalyst may contain a carrier comprising zeolite having a 10-membered ring one dimensional pore structure and a binder, and platinum and/or palladium supported on the carrier, and having a carbon content of 0.4 to 3.5% by mass; and the zeolite may be derived from an ion-exchanged zeolite obtained by ion exchanging an organic template-containing zeolite containing an organic template and having a 10-membered ring one dimensional pore structure in a solution comprising ammonium ions and/or protons.

Further, in an aspect of the present invention, the third step may be a step of obtaining the dewaxed oil by allowing the base oil fraction to contact a hydroisomerization dewaxing catalyst, wherein the hydroisomerization dewaxing catalyst may be a hydroisomerization dewaxing catalyst containing a carrier comprising zeolite having a 10-membered ring one dimensional pore structure and a binder, and platinum and/or palladium supported on the carrier, and having a micropore volume of 0.02 to 0.12 ml/g, the above zeolite derived from an ion-exchanged zeolite obtained by ion exchanging an organic template-containing zeolite containing an organic template and having a 10-membered ring one dimensional pore structure in a solution comprising ammonium ions and/or protons, and having a micropore volume per unit mass of the zeolite may be 0.01 to 0.12 ml/g. Note that the micropore as used in the present specification is "a pore having a diameter of 2 nm or less" as defined in IUPAC (International Union of Pure and Applied Chemistry).

Advantageous Effects of Invention

According to the present invention, a method for producing a base oil for lubricant oils capable of efficiently providing a base oil for lubricant oils having good viscometric properties from a stock oil containing a heavy matter having 30 or more carbon atoms and, in some cases, also containing sulfur and nitrogen.

BRIEF DESCRIPTION OF DRAWINGS

FIG. 1 is a flow diagram showing an example of the apparatus for producing a base oil for lubricant oils for carrying out the method for producing a base oil for lubricant oils of the present invention.

DESCRIPTION OF EMBODIMENTS

Hereinafter, the preferred embodiments of the present invention is described with reference to the drawings.

The method for producing a base oil for lubricant oils according to the present embodiment comprises a first step of hydrocracking a stock oil having a content percentage of a heavy matter having 30 or more carbon atoms of 80% by mass or more under a condition of a partial pressure of hydrogen of 5 to 20 MPa so that a crack per mass of the heavy fraction is 20 to 85% by mass, to obtain a hydrocracked oil comprising the heavy matter and a hydrocracked product thereof (hereinafter, in some cases, referred to as "hydrocracking step"), a second step of fractionating the hydrocracked oil into an intended base oil fraction comprising the hydrocracked product and a heavy fraction containing the heavy matter and being heavier than the base oil fraction (hereinafter, in some cases, referred to as "the first separation step"), and a third step of isomerization dewaxing the base oil fraction from the fractionation to obtain a dewaxed oil (hereinafter, in some cases, referred to as "dewaxing step"). Further, according to the present embodiment, the heavy fraction from the fractionation in the second step can be supplied to the first step as a part of the stock oil.

In the present embodiment, a base oil for lubricant oils can be obtained by a known method from the dewaxed oil obtained in the third step. More specifically, according to the production method of the present embodiment, a base oil for lubricant oils can be efficiently produced by obtaining a dewaxed oil through each of the above steps from a heavy matter having 30 or more carbon atoms.

The production method of the present embodiment may further comprise a fourth step of hydrorefining the dewaxed oil obtained in the third step to obtain a hydrorefined oil (hereinafter, in some cases, referred to as "hydrorefining step"), and a fifth step of fractionating the hydrorefined oil to obtain a base oil for lubricant oils (hereinafter, in some cases, referred to as "the second separation step").

Each of the steps is described in detail below.

(Hydrocracking Step)

In the hydrocracking step, a hydrocracked oil comprising a heavy matter and a hydrocracked product thereof is obtained by hydrocracking a stock oil having a content percentage of the heavy matter having 30 or more carbon atoms of 80% by mass or more under a condition of a partial pressure of hydrogen of 5 to 20 MPa so that a crack per mass of the heavy matter is 20 to 85% by mass.

Note that, in the present specification, the crack per mass (% by mass) of the heavy matter can be determined using a formula $((C_1-C_2)/C_1)\times100$ when a content percentage of the heavy matter having 30 or more carbon atoms in the stock oil is $C_1$ and a content percentage of the heavy matter having 30 or more carbon atoms in the hydrocracked oil obtained through hydrocracking is $C_2$.

In the hydrocracking step, the heavy matter is converted to hydrocarbon having a lower boiling point than the heavy matter. A part of which is a suitable base oil fraction to be used for a base oil for lubricant oils, whereas other parts of which are light fractions lighter than the base oil fraction (examples include fuel oil fractions and solvent fractions). Also, other parts (15 to 80% by mass) of the heavy matter are not sufficiently hydrocracked and remains in the hydrocracked oil as the uncracked heavy content. Note that the "hydrocracked oil" refers to all of the hydrocracked products including the uncracked heavy matter, unless otherwise stated.

The stock oil has a content percentage of the heavy matter having 30 or more carbon atoms of 80% by mass or more, and preferably 85% by mass or more. Further, the content percentage of hydrocarbon having 30 or more and 60 or less carbon atoms in the stock oil is preferably 65% by mass or more, and more preferably 70% by mass or more.

The upper limit of content percentage of the heavy matter having 30 or more carbon atoms in the stock oil is not particularly limited and may be, for example, 100% by mass. Further, the upper limit of content percentage of hydrocarbon having 30 or more and 60 or less carbon atoms in the stock oil is also not particularly limited and may be, for example, 100% by mass.

Note that the carbon number distribution of the hydrocarbon in the stock oil can be measured using gas chromatograph.

The stock oil to be used is preferably a hydrocarbon oil derived from petroleum containing petroleum derived hydrocarbon. Examples of the hydrocarbon oil derived from petroleum include vacuum gas oil and hydrorefined oil thereof, vacuum gas oil hydrocracked oil, atmospheric residual oil hydrocracked oil, vacuum residual oil hydrocracked oil, slack wax, foot's oil, dewaxed oil, paraffin wax, microcrystalline wax, and solvent extraction raffinate.

Note that the vacuum gas oil is a distillate obtained from a vacuum distillation apparatus of a stock oil and is a hydrocarbon oil having a boiling point ranging from about 350 to about 550° C. Further, the atmospheric residual oil is a bottom oil extracted from an atmospheric distillation apparatus and is a hydrocarbon oil having a boiling point ranging from 350° C. or more. Furthermore, the vacuum residual oil is a bottom oil extracted from a vacuum distillation apparatus and is a hydrocarbon oil having a boiling point ranging from 550° C. or more. The vacuum gas oil hydrocracked oil is a hydrocarbon oil obtained by hydrocracking a vacuum gas oil, the atmospheric residual oil hydrocracked oil is a hydrocarbon oil obtained by hydrocracking an atmospheric residual oil, and the vacuum residual oil hydrocracked oil is a hydrocarbon oil obtained by hydrocracking a vacuum residual oil.

Further, the stock oil may be a mixture of the hydrocarbon oil derived from petroleum described above and a heavy fraction from the fractionation in a second step to be described later (hereinafter, in some cases, referred to as "recycled oil").

The stock oil may contain sulfur, and the content percentage of sulfur may be, for example, 0.0001 to 3.0% by mass, 0.001 to 1.0% by mass, or 0.01 to 0.5% by mass. In the hydrocracking step of the present embodiment, desulfurization proceeds along with the hydrocracking of the stock oil and hence even when sulfur is contained in the stock oil in the above range, the deterioration of the hydroisomerization dewaxing catalyst, or the like, by sulfur in the subsequent step can be well prevented.

The stock oil may contain nitrogen and a content percentage of nitrogen may be, for example, 0.0001 to 0.5% by mass, 0.001 to 0.1% by mass.

The stock oil may have a kinematic viscosity at 100° C. of 6.0 to 100.0 $mm^2/s$, or 7.0 to 50.0 $mm^2/s$.

In the hydrocracking step, 20 to 85% by mass of the heavy matter is hydrocracked by the hydrocracking of the stock oil. When a crack per mass of the heavy matter in the hydrocracking step exceeds 85% by weight, a throughput of the stock oil per unit time increases, while the heavy matter is over cracked producing too much of light fractions, thereby reducing the yield of a base oil for lubricant oils. When a crack per mass of the heavy matter is below 20% by mass, the production of light fractions can be controlled but a throughput of the heavy matter per unit time is reduced. More specifically, when a crack per mass of the heavy matter by hydrocracking is adjusted to 20 to 85% by mass, the throughput of heavy matter and the yield of a base oil for lubricant oils are well balanced, enhancing the production efficiency (a production per unit time) of a base oil for lubricant oils.

Further, when a crack per mass of the heavy matter is 10% by mass or more, the desulfurization and denitrification proceed sufficiently in the hydrocracking step even when the stock oil contains sulfur and nitrogen as described above and hence the adverse influence to the hydroisomerization dewaxing catalyst, or the like, in the subsequent step is adequately controlled.

As opposed to this, when the hydrocracking step is set to the condition under which a crack per mass of the heavy matter is below 10% by mass, desulfurization does not sufficiently proceed leaving a large amount of sulfur contained in the stock oil to the subsequent step. In this case, to prevent the catalytic activity of a hydroisomerization dewaxing catalyst, or the like, from deteriorating, the condition of isomerization dewaxing must be set even much more strictly in the dewaxing step. Thus, when the condition of isomerization dewaxing is set more strictly, a crack per mass increases and a yield of the intended base oil for lubricant oils reduces.

Further, when hydrocracking is carried out so that a crack per mass of the heavy matter is 20 to 85% by mass and under the condition of a partial pressure of hydrogen of 5 to 20 MPa, the obtained base oil for lubricant oils results in good viscometric properties (a high viscosity index). More specifically, the production method according to the present embodiment, a base oil for lubricant oils having good viscometric properties can be obtained efficiently by adopting a specific hydrocracking step.

In the hydrocracking step of the present embodiment, the stock oil is allowed to contact the hydrocracking catalyst in the presence of hydrogen to carry out hydrocracking. Note that the hydrocracking catalyst and the conditions for hydrocracking reaction can be suitably selected from the range in which a crack per mass of the heavy matter is 20 to 85% by mass in reference to the hydrocracking catalyst and the reaction conditions at that time to be described later, except that a partial pressure of hydrogen is 5 to 20 MPa.

Specific examples of the preferable hydrocracking catalyst include the following hydrocracking catalyst A.

Hydrocracking catalyst A comprises a porous inorganic oxide composed of 2 or more elements selected from aluminium, silicon, zirconium, boron, titanium and magnesium and at least 1 metal selected from the elements belonging to the Group 6, Group 8, Group 9 and Group 10 in the periodic table supported on the porous inorganic oxide. According to the hydrocracking catalyst A, even when the stock oil contains sulfur and nitrogen in the range described above, the reduction of catalytic activity caused by sulfur poisoning is sufficiently controlled.

For the carrier of the hydrocracking catalyst A, the porous inorganic oxide composed of at least 2 elements selected from aluminium, silicon, zirconium, boron, titanium, and magnesium is used. The porous inorganic oxide is preferably 2 or more selected from aluminium, silicon, zirconium, boron, titanium, and magnesium from a viewpoint of further enhancing hydrocracking activity, and more preferably an inorganic oxide containing aluminium and other elements (a complex oxide of an aluminum oxide and other oxides). Also, the carrier for the hydrocracking catalyst A may be an inorganic carrier having solid acidity.

When the porous inorganic oxide contains aluminium as a constituent element, a content of aluminium is, in terms of alumina, preferably 1 to 97% by mass, more preferably 10 to 95% by mass, and further preferably 20 to 90% by mass, based on the total amount of porous inorganic oxide. When an aluminium content, in term of alumina, is below 1% by mass, physical properties such as carrier acidity, and the like, are not suitable, unlikely exhibiting sufficient hydrocracking activity. On the other hand, when an aluminium content, in terms of alumina, exceeds 97% by mass, the solid acidity strength of the catalyst becomes inadequate, likely reducing the activity.

The method for introducing silicon, zirconium, boron, titanium, and/or magnesium, which is the carrier constituent element other than aluminium, is not particularly limited and a solution containing these elements may be used as a feedstock. For example, silicon, water glass, or silica sol for silicon, boric acid for boron, phosphoric acid or alkali metal salts of phosphoric acid for phosphorus, titanium sulfide, titanium tetrachloride, various alkoxide salts for titanium, zirconium sulfurate and various alkoxide salts for zirconium can be used.

Further, the porous inorganic oxide may contain phosphorus as a constituent element. When phosphorus is contained, a content thereof is, in terms of an oxide, preferably 0.1 to 10% by mass, more preferably 0.5 to 7% by mass, and further preferably 2 to 6% by mass based on the total amount of the porous inorganic oxide. When a phosphorus content is below 0.1% by mass, sufficient hydrocracking activity is not likely to be exhibited, whereas a content exceeds 10% by mass, hydrocracking may excessively proceed.

The feedstocks of carrier constituent component other than the aluminium oxide described above are preferably added in a step before the carrier is calcined. For example, the above feedstock is added in advance to an aluminium aqueous solution, subsequently an aluminium hydroxide gel containing these constituent components may be prepared, or the above feedstock material may be added to the blended aluminium hydroxide gel. Alternatively, the above feedstock may be added during the step of adding and kneading water or an acid aqueous solution to a commercial aluminium oxide intermediate or a boehmite powder, but more preferably is caused to co-exist at the stage of blending an aluminium hydroxide gel. Further, the carrier constituent components other than an aluminium oxide are prepared in advance, and an alumina feedstock such as a boehmite powder, or the like, may be blended therewith. The effect production mechanism of the carrier constituent components other than an aluminium oxide is not necessarily clarified, but the components are presumed to form a complex oxidation state with aluminium which is considered to increase the carrier surface area and produce an interaction with an active metal by which the activity is influenced.

The above porous inorganic oxide as the carrier supports at least 1 metal selected from the elements belonging to the Groups 6, Group 8, Group 9 and Group 10 of the periodic table. Of these metal, it is preferred to use at least 2 metals selected from cobalt, molybdenum, nickel, and tungsten in combination. Examples of the preferable combination include cobalt-molybdenum, nickel-molybdenum, nickel-cobalt-molybdenum, and nickel-tungsten. Of these, the combinations of nickel-molybdenum, nickel-cobalt-molybdenum, and nickel-tungsten are more preferable. For hydrocracking, these metals are used as converted to a state of sulfide.

For a content of the active metal based on a catalyst mass, the total amount of tungsten and molybdenum supported ranges preferably from 12 to 35% by mass, and more preferably 15 to 30% by mass, in terms of the oxide. When the total amount of tungsten and molybdenum supported is below 12% by mass, the active sites become fewer, likely failing to achieve sufficient activity. On the other hand, when the total supported amount exceeds 35% by mass, the metals are not effectively dispersed, likely failing to achieve sufficient activity. The total amount of cobalt and nickel supported ranges preferably 1.0 to 15% by mass, and more preferably 1.5 to 13% by mass, in terms of the oxide. When the total amount of cobalt and nickel supported is below 1.0% by mass, sufficient co-catalyst effects are not achieved and the activity tends to be reduced. On the other hand, when the total amount supported exceeds 15% by mass, the metals are not effectively dispersed, likely failing to achieve sufficient activity.

The above porous inorganic oxide as the carrier preferably supports phosphorous with an active metal as the active component. The amount of phosphorous supported on the carrier is in terms of oxide, preferably 0.5 to 10% by mass, and more preferably 1.0 to 5.0% by mass. When an amount of phosphorous supported is below 0.5% by mass, the effect of phosphorous is not sufficiently exhibited, whereas an amount thereof supported exceeds 10% by mass, the acidity properties of the catalyst become strong, likely causing a cracking reaction. The method for supporting phosphorous on the carrier is not particularly limited, and phosphorous may be allowed to co-exist in an aqueous solution containing a metal belonging to the Groups 8 to 10 and a metal belonging to the Group 6 in the periodic table described above and supported, or may be successively supported before or after a metal is supported.

The method for containing these active metals in the catalyst is not particularly limited, and a known method routinely adopted for producing a hydrocracking catalyst can be used. Typically, the method for impregnating a catalyst support with a solution containing a salt of an active metal is preferably employed. Alternatively, equilibrium adsorption method, pore-filling method, and incipient-wetness method are also preferably employed. For example, the pore-filling method is a method in which a pore volume of the carrier is measured in advance and the carrier is impregnated with a metal salt solution in an equal volume to the measured volume. Note that the impregnation method is not particularly limited and can be carried out by a suitable method in accordance with an amount of metal supported and physical properties of a catalyst carrier.

In the present embodiment, the number of kinds of hydrocracking catalyst A used is not particularly limited. For example, a catalyst of one kind may be used singly, or a plural of catalysts having different active metal species and carrier constituent components may be used. Examples of the preferable combination for using several different catalysts include a nickel-molybdenum containing catalyst followed by a cobalt-molybdenum containing catalyst in a subsequent step, a nickel-molybdenum containing catalyst followed by a nickel-cobalt-molybdenum containing catalyst in a subsequent step, a nickel-tungsten containing catalyst followed by a nickel-cobalt-molybdenum containing catalyst in a subsequent step, a nickel-cobalt-molybdenum containing catalyst followed by a cobalt-molybdenum containing catalyst in a subsequent step. A nickel-molybdenum catalyst may further be combined in the previous or subsequent step of these combinations.

When several catalysts having different carrier components are combined, a catalyst having an aluminium oxide content range of 80 to 99% by mass may be used in the subsequent step of a catalyst having an aluminium oxide content of 30% by mass or more and below 80% by mass, based on the total mass of the carrier.

Further, in addition to the hydrocracking catalyst A, a guard catalyst, a demetallizing catalyst, and/or an inactive filler may be used as necessary for the purpose of trapping a scale content which flows in along with the base oil fraction or supporting the hydrocracking catalyst A at the partition of the catalyst bed. Note that these can be used singly or in combination.

The pore volume of the hydrocracking catalyst A by a nitrogen absorption BET method is preferably 0.30 to 0.85 ml/g, and more preferably 0.45 to 0.80 ml/g. When a pore volume is below 0.30 ml/g, the dispersibility of the supported metal becomes insufficient, likely reducing the active sites. Further, when a pore volume exceeds 0.85 ml/g, the catalyst strength becomes insufficient, likely causing the catalyst to powder and crush while in use.

Further, the average pore diameter of the catalyst determined by a nitrogen adsorption BET method is preferably 5 to 15 nm, and more preferably 6 to 12 nm. When an average pore diameter is below 5 nm, the reaction substrate is not sufficiently dispersed in the pores, likely deteriorating the reactivity. On the other hand, when an average pore diameter exceeds 15 nm, the pore surface area decreases, likely causing insufficient activity.

Furthermore, in the hydrocracking catalyst A, it is preferable that the ratio of the pore volume derived from pores having a pore diameter of 3 nm or less to the total pore volume is 35% by volume or less for maintaining effective catalyst pores and achieving sufficient activities.

When the hydrocracking catalyst A is used, the conditions for hydrocracking are set to, for examples, a hydrogen pressure of 2 to 20 MPa, a liquid hourly space velocity (LHSV) of 0.1 to 3.0 $h^{-1}$, and a hydrogen oil ratio (hydrogen/oil ratio) of 150 to 1500 $Nm^3/m^3$, preferably a hydrogen pressure of 3 to 15 MPa, a liquid hourly space velocity of 0.3 to 1.5 $h^{-1}$, and a hydrogen oil ratio (hydrogen/oil ratio) of 380 to 1200 $Nm^3/m^3$, more preferably a hydrogen pressure of 4 to 10 MPa, a liquid hourly space velocity of 0.3 to 1.5 $h^{-1}$, and a hydrogen oil ratio of 350 to 1000 $Nm^3/m^3$. These conditions are the factors which determine the reaction activity, and, for example, when the hydrogen pressure and the hydrogen oil ratio are below the lower limits described above, the reactivity tends to decrease and the catalytic activity tends to rapidly drop. On the other hand, when the hydrogen pressure and the hydrogen oil ratio exceed the upper limits described above, an excessive investment in equipment such as a compressor is likely to be required. Further, the lower the liquid hourly space velocity tends to be more advantageous to the reaction but when it is below the lower limit values described above, a reactor having an extremely large internal volume is required and an excessive investment in equipment tends to be required, whereas when the liquid hourly space velocity exceeds the upper limit values described above, the reaction tends not to sufficiently proceed. Furthermore, examples of the reaction temperature include 180 to 450° C., preferably 250 to 420° C., more preferably 280 to 410° C., and particularly preferably 300 to 400° C. When a reaction temperature exceeds 450° C., not only does the yield of the base oil fraction decrease due to the proceeding cracking into a light fraction, but the product is colored and hence tends to have a limited use as a base material for a final product. On the other hand, when a reaction temperature is below 180° C., the hydrocracking reaction does not sufficiently proceed, sometimes failing to achieve a crack per mass of the heavy matter of 20 to 85% by mass.

As an aspect of the hydrocracking step, the stock oil may be those containing a slack wax having a 10% by volume distillation temperature of 500 to 600° C. and a 90% by volume distillation temperature of 600 to 700° C. (hereinafter referred to as "the first slack wax"). In the aspect like this, it is preferred to carry out the hydrocracking so that a crack per mass of the heavy matter is 25 to 85% by mass. Thus, a base oil for lubricant oils having good viscometric properties can be obtained even more efficiently.

In the above aspect, the stock oil may be those containing the first slack wax and the heavy fraction, which is obtained by subjecting the first slack wax to the hydrocracking step and the first separation step. More specifically, when the stock oil contains a fresh feed and the heavy fraction recycled (recycled oil) from the first separation step, the fresh feed preferably contains the above first slack wax. At this point, the content of the first slack wax in the fresh feed is, based on the total amount of the fresh feed, preferably 80% by mass or more, more preferably 90% by mass or more.

The density of the first slack wax at 15° C. is preferably 0.89 to 0.92 $g/cm^3$, and more preferably 0.90 to 0.915 $g/cm^3$. Further, the kinematic viscosity of the first slack wax at 100° C. is preferably 15 to 30 $mm^2/s$, and more preferably 18 to 28 $mm^2/s$.

The first slack wax may contain 0.0001 to 3.0% by mass of sulfur. Further, sulfur of the first slack wax is preferably 0.0001 to 1.0% by mass, and more preferably 0.0001 to 0.5% by mass.

The first slack wax may also contain 0.0001 to 0.5% by mass of nitrogen. Further, nitrogen of the first slack wax is preferably 0.0001 to 0.1% by mass, and more preferably 0.0001 to 0.01% by mass.

In the first slack wax, a content percentage of the hydrocarbon (heavy matter) having 30 or more carbon atoms is preferably 90% by mass or more, and more preferably 95% by mass or more. Further, a content percentage of the hydrocarbon having 30 or more and 60 or less carbon atoms is preferably 70% by mass or more, and more preferably 75% by mass or more.

Further, as another aspect of the hydrocracking step, the stock oil may be those containing a slack wax having a 10% by volume distillation temperature of 400 to 500° C. and a 90% by volume distillation temperature of 500 to 600° C. (hereinafter referred to as "the second slack wax"). In such an aspect, it is preferred to carry out the hydrocracking so that a crack per mass of the heavy matter is 20 to 80% by mass. Thus, a base oil for lubricant oils having good viscometric properties can be obtained even more efficiently.

In the above aspect, the stock oil may be those containing the second slack wax and the heavy fraction, which is obtained by subjecting the second slack wax to the hydrocracking step and the first separation step. More specifically, when the stock oil contains a fresh feed and the heavy fraction recycled from the first separation step, the fresh feed preferably contains the above second slack wax. At this point, the content of the second slack wax in the fresh feed is, based on the total amount of the fresh feed, preferably 80% by mass or more, more preferably 90% by mass or more.

The density of the second slack wax at 15° C. is preferably 0.83 to 0.89 $g/cm^3$, more preferably 0.84 to 0.88 $g/cm^3$. Further, the kinematic viscosity of the second slack wax at 100° C. is preferably 5 to 15 $mm^2/s$, and more preferably 6.0 to 10 $mm^2/s$.

The second slack wax may contain 0.0001 to 3.0% by mass of sulfur. Further, sulfur of the second slack wax is preferably 0.0001 to 1.0% by mass, and more preferably 0.0001 to 0.5% by mass.

The second slack wax may also contain 0.0001 to 0.5% by mass of nitrogen. Further, nitrogen of the second slack wax is preferably 0.0001 to 0.1% by mass, and more preferably 0.0001 to 0.01% by mass.

In the second slack wax, a content percentage of the hydrocarbon (heavy matter) having 30 or more carbon atoms is preferably 85% by mass or more, and more preferably 90% by mass or more. Further, a content percentage of the hydrocarbon having 30 or more and 60 or less carbon atoms is preferably 85% by mass or more, and more preferably 90% by mass or more.

(First Separation Step)

In the first separation step, the hydrocracked oil obtained in the hydrocracking step is fractionated into a base oil fraction containing a hydrocracked product (e.g., hydrocarbon having below 30 carbon atoms) and the heavy fraction containing the heavy matter and being heavier than the base oil fraction. Also, in some cases, the hydrocracked oil is further fractionated into a light fraction such as gas, naphtha, or kerosene.

The base oil fraction is the fraction for obtaining a base oil for lubricant oils via the dewaxing step (and, as necessary, the hydrorefining step and the second separation step) to be described later, and the boiling point range thereof can be suitably changed in accordance with an intended product.

The base oil fraction is preferably a fraction having a 10% by volume distillation temperature of 280° C. or more and a 90% by volume distillation temperature of 530° C. or less. When the base oil fraction is set to be a fraction having a boiling point range of the above range, a useful base oil for lubricant oils can be produced more efficiently. Note that, in the present specification, the 10% by volume distillation temperature and the 90% by volume distillation temperature are the values to be measured in conformity with JIS K2254 "Petroleum products—Determination of distillation characteristics—Gas chromatograph system".

The heavy fraction is a fraction of heavy having a higher boiling point than the base oil fraction. More specifically, the heavy fraction is a fraction having a higher 10% by volume distillation temperature than a 90% by volume distillation temperature of the base oil fraction, for example, a fraction having a 10% by volume distillation temperature of higher than 530° C.

The hydrocracked oil, in some cases, contains a light fraction of light having a lower boiling point (light fraction) than the base oil fraction in addition to the base oil fraction and the heavy fraction. The light fraction is a fraction having a lower 90% by volume distillation temperature than a 10% by volume distillation temperature of the base oil fraction, for example, a fraction having a 90% by volume distillation temperature of lower than 280° C.

The distillation conditions during the first separation step are not particularly limited as long as the conditions are set to fractionate the hydrocracked oil into the base oil fraction and the heavy fraction. For example, the first separation step may be a step of fractionating the hydrocracked oil into the base oil fraction and the heavy fraction by vacuum distillation, or may be a step of fractionating the hydrocracked oil into the base oil fraction and the heavy fraction by atmospheric distillation (or distillation under applied pressure) and vacuum distillation in combination.

For example, when the hydrocracked oil contains a light fraction, the first separation step can be carried out by the atmospheric distillation (or distillation under applied pressure) for distilling the light fraction from the hydrocracked oil and the vacuum distillation for fractionating the bottom oil of the atmospheric distillation into the base oil fraction and the heavy fraction.

In the first separation step, the base oil fraction may be a single fraction from the fractionation, or may be several fractions from the fractionation in accordance with the intended base oils for lubricant oils. The several base oil fractions from the fractionation can be subjected each independently to the subsequent dewaxing step. Alternatively, a part or all of the several base oil fractions are mixed and subjected to the subsequent dewaxing step.

(Dewaxing Step)

In the dewaxing step, the base oil fraction from the fractionation in the first separation step is isomerization dewaxed to obtain a dewaxed oil. The isomerization dewaxing can be carried out, in the presence of hydrogen, by allowing the base oil fraction to contact a hydroisomerization dewaxing catalyst.

For the hydroisomerization dewaxing catalyst, a catalyst routinely used for hydroisomerization, more specifically, a catalyst supporting a metal having the hydrogenolysis activity on an inorganic carrier can be used.

The metal having the hydrogenolysis activity in the hydroisomerization dewaxing catalyst used is at least 1 metal selected from the group consisting of the metals belonging to the Group 6, Group 8, Group 9 and Group 10 of the periodic table.

Specific examples of these metals include noble metals such as platinum, palladium, rhodium, ruthenium, iridium, osmium, and the like, or cobalt, nickel, molybdenum, tungsten, iron, and the like, with platinum, palladium, nickel, cobalt, molybdenum and tungsten being preferable, and platinum and palladium being further preferable. A plurality of these metals are preferably used in combination, and, in that case, examples of the preferable combination include platinum-palladium, cobalt-molybdenum, nickel-molybdenum, nickel-cobalt-molybdenum, nickel-tungsten, or the like.

Examples of the inorganic carrier composing the hydroisomerization dewaxing catalyst include metal oxides such as alumina, silica, titania, zirconia, boria, and the like. These metal oxides may be used singly or in a mixture of two or more, or as a complex metal oxide such as silica alumina, silica zirconia, alumina zirconia, alumina boria, and the like. The above inorganic carrier are preferably, in the light of effectively proceeding the hydroisomerization of normal paraffin, a complex metal oxide having solid acidity such as silica alumina, silica zirconia, alumina zirconia, alumina boria, and the like. Further, the inorganic carrier may contain a small amount of zeolite. Furthermore, the inorganic carrier may contain a binder for the purpose of improving the moldability and mechanical strengths of the carrier. Preferable examples of the binder include alumina, silica, magnesia, and the like.

The content of metal having the hydrogenolysis activity in the hydroisomerization dewaxing catalyst is, when the metal is the above noble metal, preferably about 0.1 to 3% by mass based on the mass of the carrier, in terms of metal atom. When the metal is other than the above noble metals, it is preferred that the content is about 2 to 50% by mass based on the mass of the carrier, in terms of metal oxide. When a content of the metal having the hydrogenolysis activity is below the lower limit value described above, the hydroisomerization is not likely to proceed sufficiently. However, when a content of the metal having the hydrogenolysis activity exceeds the upper limit value described above, the dispersion of metal having the hydrogenolysis activity reduces, causing the reduction of catalyst activity thereby raising the catalyst cost.

The hydroisomerization dewaxing catalyst may also be a catalyst which comprises at least 1 metal selected from the elements belonging to the Group 6, Group 8, Group 9 and Group 10 of the periodic table supported on a carrier comprising a porous inorganic oxide composed of substances selected from aluminium, silicon, zirconium, boron, titanium, magnesium and zeolite.

Preferable examples of the porous inorganic oxide used as the carrier for the hydroisomerization dewaxing catalyst include alumina, titania, zirconia, boria, silica and zeolite, and, of these, those composed of alumina and at least one of titania, zirconia, boria, silica and zeolite. The production method thereof is not particularly limited and any preparation methods using a feedstock in the state of a variety of sols and salt compounds compatible with respective element can be employed. Additionally, a complex hydroxide or a complex oxide such as silica alumina, silica zirconia, alumina titania, silica titania, alumina boria, or the like, is first prepared and subsequently added in the form of alumina gel or other hydroxides or a suitable solution for the preparation at any step during the preparation process. The ratio of alumina and other oxides can be any ratio with respect to the carrier, but is preferably 90% by mass or less, further preferably 60% by mass or less, more preferably 40% by mass or less, preferably 10% by mass or more, and more preferably 20% by mass or more, of alumina.

Zeolite is a crystalline aluminosilicate and examples include faujasite, pentasil, mordenite, TON, MTT, *MRE, and the like, and those super-stabilized by a predetermined hydrothermal treatment and/or acid treatment or those containing an adjusted alumina content in zeolite can be used.

Faujasite and mordenite are preferably used, and the Y-type and beta-type are particularly preferably used. The super-stabilized Y-type is preferred. The super-stabilized zeolite by the hydrothermal treatment have new pores ranging from 20 to 100 Å formed, in addition to the intrinsic pore structure referred to as the micropore of 20 Å or less. The hydrothermal treatment can employ the known conditions.

Examples of the active metal for hydroisomerization dewaxing catalyst usable include at least 1 metal selected from the element belonging to the Group 6, Group 8, Group 9 and Group 10 of the periodic table. Of these metals, at least 1 metal selected from Pd, Pt, Rh, Ir and Ni is preferably used, and the combined use thereof is more preferable. Examples of the preferable combination include Pd—Pt, Pd—Ir, Pd—Rh, Pd—Ni, Pt—Rh, Pt—Ir, Pt—Ni, Rh—Ir, Rh—Ni, Ir—Ni, Pd—Pt—Rh, Pd—Pt—Ir, Pt—Pd—Ni, and the like. Of these, the combinations of Pd—Pt, Pd—Ni, Pt—Ni, Pd—Ir, Pt—Rh, Pt—Ir, Rh—Ir, Pd—Pt—Rh, Pd—Pt—Ni and Pd—Pt—Ir are more preferable, and the combinations of Pd—Pt, Pd—Ni, Pt—Ni, Pd—Ir, Pt—Ir, Ni Pd—Pt—Ni and Pd—Pt—Ir are further preferable.

The total content of the active metal based on the catalyst mass is preferably 0.1 to 2% by mass, more preferably 0.2 to 1.5% by mass, and further preferably 0.25 to 1.3% by mass, in terms of metal. When the total amount of metal supported is below 0.1% by mass, the active sites are reduced and the sufficient activity tends not to be obtained. Conversely, when such an amount exceeds 2% by mass, the metals are not effectively dispersed and the sufficient activity tends not to be obtained.

In any of the above hydroisomerization dewaxing catalysts, the method for supporting the active metal on the carrier is not particularly limited, and the known method routinely used for producing the hydroisomerization dewaxing catalyst is employed. Typically, the method in which a catalyst carrier is impregnated with a solution containing a salt of the active metal is preferably employed. Equilibrium adsorption method, pore-filling method, incipient-wetness method, or the like, is also preferably employed. For example, the pore-filling method is a method in which the pore volume of the carrier is measured in advance and the carrier is impregnated with a metal salt solution in a volume equivalent to the volume as the measured volume, however, the impregnation method is not particularly limited and the impregnation can be carried out by a suitable method in accordance with the amount of metal supported and the physical properties of catalyst carrier.

For the hydroisomerization dewaxing catalyst, the following catalysts can also be used.

<A Specific Aspect of the Hydroisomerization Dewaxing Catalyst>

The hydroisomerization dewaxing catalyst of the present aspect is produced by a specific method, by which the distinctive features thereof are imparted. Hereinafter, the hydroisomerization dewaxing catalyst of the present aspect is described with reference to preferred aspects of the production thereof.

The method for producing the hydroisomerization dewaxing catalyst of the present aspect comprises a first step of heating at a temperature of 250 to 350° C. under $N_2$ atmosphere a mixture, which contains a binder and an ion-exchanged zeolite obtained by ion exchanging an organic template-containing zeolite containing an organic template and having a 10-membered ring one dimensional pore structure, in a solution containing ammonium ions and/or protons, to obtain a carrier precursor, and a second step of calcining a catalyst precursor, wherein the carrier precursor is impregnated with platinum salt and/or palladium salt, in an atmosphere containing molecular oxygen at a temperature of 350 to 400° C., to obtain a hydroisomerization dewaxing catalyst in which platinum and/or palladium is supported on a zeolite-containing carrier.

The organic template-containing zeolite used in the present aspect has a one dimensional pore structure made of a 10-membered ring, in view of achieving a high level of both high isomerization activity and suppressed cracking activity in the hydroisomerization reaction of a normal paraffin. Examples of such a zeolite include AEL, EUO, FER, HEU, MEL, MFI, NES, TON, MTT, WEI, *MRE and SSZ-32. Note that each of the above three alphabetical letters stands for the skeletal structure code assigned to each structure of the classified molecular sieve type zeolites by The Structure Commission of The International Zeolite Association. In addition, the zeolites having the same topology are collectively referred by the same code.

The organic template-containing zeolite described above are, among the zeolites having the 10-membered ring one dimensional pore structure, preferably the zeolites having the TON or MTT structure, ZSM-48 zeolite and SSZ-32 zeolite having the *MRE structure, in view of the high isomerization activity and low cracking activity. The zeolite having the TON structure is preferably ZSM-22 zeolite, and the zeolite having the MTT structure is preferably ZSM-23 zeolite.

The organic template-containing zeolite is hydrothermally synthesized by a known method from a silica source, an alumina source and an organic template, which is added to build the above predetermined pore structure.

The organic template is an organic compound having an amino group, an ammonium group, and the like, and is selected in accordance with the structure of the zeolite to be synthesized but an amine derivative is preferable. More specifically, the organic template is preferably at least one selected from the group consisting of alkylamine, alkyldiamine, alkyltriamine, alkyltetramine, pyrrolidine, piperazine, aminopiperazine, alkylpentamine, alkylhexamine, and the derivatives thereof. Examples of the number of carbon atoms in the above alkyls include 4 to 10, with 6 to 8 being preferable. Note that examples of the representative alkyldiamine include 1,6-hexadiamine and 1,8-diaminooctane.

The molar ratio of the silicon element to aluminium element ([Si]/[Al]) (hereinafter referred to as the "Si/Al ratio") composing the organic template-containing zeolite having a 10-membered ring one dimensional pore structure is preferably 10 to 400, and more preferably 20 to 350. When an Si/Al ratio is below 10, the activity to the conversion of normal paraffins increases, whereas the isomerization selectivity to isoparaffins decreases, and the cracking reactions caused by an increase in the reaction temperature tend to abruptly increase, hence not preferable. On the other hand, when an Si/Al ratio exceeds 400, the catalytic activity required for the conversion of normal paraffins becomes difficult to obtain, hence not preferable.

The above organic template-containing zeolite, which is synthesized, preferably washed and dried, typically has alkali metal cations as counter cations, and incorporates the organic template in the pore structure. The organic template-containing zeolite used for producing the hydroisomerization dewaxing catalyst according to the present invention is preferably in such a synthesized state, that is, the zeolite has not been subjected to a calcining treatment for removing the organic template incorporated therein.

The above organic template-containing zeolite is subsequently ion exchanged in a solution containing ammonium ions and/or protons. By the ion exchange, the counter cations contained in the organic template-containing zeolite are exchanged for ammonium ions and/or protons. Further, at the same time, a part of the organic template incorporated in the organic template-containing zeolite is removed.

The solution used for the above ion exchange treatment is preferably a solution which uses a solvent containing at least 50% by volume of water, and more preferably is an aqueous solution. Examples of the compounds for supplying ammonium ions into the solution include various inorganic and organic ammonium salts such as ammonium chloride, ammonium sulfate, ammonium nitrate, ammonium phosphate, and ammonium acetate. On the other hand, mineral acids such as hydrochloric acid, sulfuric acid and nitric acid are typically used as compounds for supplying protons into the solution. The ion-exchanged zeolite (herein, ammonium form zeolite) obtained by ion exchange of the organic template-containing zeolite in the presence of ammonium ions releases ammonia during subsequent calcination, whereby converting the counter cations into protons to form Bronsted acid sites. Ammonium ions are preferable as the cationic species for the ion exchange. The content of ammonium ions and/or protons in the solution is preferably set to be 10 to 1000 equivalents based on the total amount of counter cations and organic template contained in the organic template-containing zeolite used.

The ion exchange treatment may be carried out on the organic template-containing zeolite simple substrate in powder form, or alternatively prior to the ion exchange treatment, the organic template-containing zeolite may be blended with an inorganic oxide, which is a binder, and molded, and the ion exchange treatment may be carried out on the obtained molded product. However, when the molded product is subjected to the ion exchange treatment in an uncalcined state, problems such as disintegration and powdering of the molded product are likely to occur. For this reason, it is preferred to subject the organic template-containing zeolite in powder form to the ion exchange treatment.

The ion exchange treatment is preferably carried out based on a standard method, i.e., a method in which the organic template-containing zeolite is immersed in a solution, preferably an aqueous solution, containing ammonium ions and/or protons, followed by stirring or fluidizing. Further, the above stirring or fluidization is preferably carried out with heating to enhance the ion exchange efficiency. In the present aspect, a method in which the above aqueous solution is heated, boiled and ion exchanged under reflux is particularly preferable.

Further, in view of enhancing the ion exchange efficiency, it is preferred to exchange the solution with a fresh solution once or twice or more, and more preferably exchange the solution with a fresh solution once or twice, during the ion exchange of the zeolite in a solution. When exchanging the solution once, the ion exchange efficiency can be enhanced by, for example, immersing the organic template-containing zeolite in a solution containing ammonium ions and/or protons, and heating the solution under reflux for 1 to 6 hours, followed by exchanging the solution with a fresh solution, and further heating under reflux for 6 to 12 hours.

By the ion exchange treatment, substantially all of the counter cations such as alkali metal in the zeolite can be exchanged for ammonium ions and/or protons. On the other hand, as to the organic template incorporated in the zeolite, a part of the organic template is removed by the above ion exchange treatment, but it is generally difficult to remove all of the organic template even when the same treatment is repeatedly carried out and consequently a part thereof remains inside the zeolite.

In the present aspect, a carrier precursor is obtained by heating a mixture, in which the ion-exchanged zeolite and the binder are included, in a nitrogen atmosphere at a temperature of 250 to 350° C.

The mixture, in which the ion-exchanged zeolite and the binder are included, is preferably obtained by blending an inorganic oxide, which is a binder, with the ion-exchanged zeolite obtained by the method described above and molding the obtained composition. The purpose of blending an inorganic oxide with the ion-exchanged zeolite is to increase the mechanical strengths of the carrier (particularly, a particulate carrier) obtained by calcining the molded product to a degree which can withstand practical application, but the present inventors found that the selection of the type of inorganic oxide affects the isomerization selectivity of the hydroisomerization dewaxing catalyst. From this perspective, at least one inorganic oxide selected from alumina, silica, titania, boria, zirconia, magnesia, ceria, zinc oxide, phosphorus oxide, and composite oxides containing a combination of 2 or more of these oxides can be used as the inorganic oxide as described above. Among the above, silica and alumina are preferred, with alumina being more preferred, from a view of further enhancing the isomerization selectivity of the hydroisomerization dewaxing catalyst. The above "composite oxide containing a combination of 2 or more of these oxides" refers to a composite oxide containing at least 2 components from alumina, silica, titania, boria, zirconia, magnesia, ceria, zinc oxide, and phosphorus oxide, but is preferably an alumina-based composite oxide containing 50% by mass or more of an alumina component based on the composite oxide, with alumina-silica being more preferable among those.

The blending ratio of the ion-exchanged zeolite and the inorganic oxide in the above composition is preferably 10:90 to 90:10, and more preferably 30:70 to 85:15, in terms of the mass ratio of the ion-exchanged zeolite:the inorganic oxide. When this ratio is less than 10:90, the activity of the hydroisomerization dewaxing catalyst tends to be insufficient, hence not preferable. Conversely, when the above ratio exceeds 90:10, the mechanical strength of the carrier obtained by molding and calcining the composition tends to be insufficient, hence not preferable.

The method for blending the inorganic oxide with the ion-exchanged zeolite is not particularly limited, but a general method can be employed, such as, for example, a method in which a suitable amount of a liquid such as water is added to the powders of both components to form a viscous fluid, and the fluid is kneaded in a kneader, or the like.

The composition containing the ion-exchanged zeolite and the inorganic oxide, or a viscous fluid including the composition, is molded by a method such as extrusion molding, and is preferably dried, to form a particulate molded product. The shape of the molded product is not particularly limited, and examples include a cylindrical shape, a pellet shape, a spherical shape, and an irregular tubular shape having a three leaf shaped or a four leaf shaped cross-section. The size of the molded product is not particularly limited, but is preferably, for example, about 1 to 30 mm in the long axis and about 1 to 20 mm in the short axis, from the perspective of the ease of handling, the load density in the reactor, and the like.

In the present aspect, it is preferred to form the carrier precursor by sufficiently drying the thus-obtained molded product at 100° C. or less and subsequently heating in an $N_2$ atmosphere at a temperature of 250 to 350° C. The heating time is preferably 0.5 to 10 hours, and more preferably 1 to 5 hours.

In the present aspect, when the above heating temperature is less than 250° C., a large amount of the organic template remains and the zeolite pores become blocked with the remained template. The isomerization active sites are thought to exist near the pore mouth, and in the above case, the reaction substrate cannot disperse into the pores due to the pore blockage, so that the active sites become covered, the isomerization reaction does not easily proceed, and a normal paraffin conversion rate tends not to be sufficiently achieved. On the other hand, when the heating temperature exceeds 350° C., the isomerization selectivity of the obtained hydroisomerization dewaxing catalyst does not improve sufficiently.

The lower limit temperature at the time of heating the molded product to prepare the carrier precursor is preferably 280° C. or more. Further, the upper limit temperature is preferably 330° C. or less.

In the present aspect, it is preferred to heat the above mixture so that a part of the organic template included in the molded product remains. Specifically, it is preferred to set the heating conditions so that the carbon content of the hydroisomerization dewaxing catalyst obtained by calcining after the metal supporting to be described later is 0.4 to 3.5% by mass (preferably 0.4 to 3.0% by mass, more preferably 0.4 to 2.5% by mass, and further preferably 0.4 to 1.5% by mass), or the micropore volume per unit mass of the catalyst is 0.02 to 0.12 ml/g and the micropore volume per unit mass of the zeolite contained in the catalyst is 0.01 to 0.12 ml/g.

Next, the catalyst precursor incorporating a platinum salt and/or palladium salt in the above carrier precursor is calcined in an atmosphere containing molecular oxygen at a temperature of 250 to 400° C., preferably 280 to 400° C., and more preferably 300 to 400° C., to obtain a hydroisomerization dewaxing catalyst in which platinum and/or palladium is supported on a zeolite-containing carrier. Note that the term "in an atmosphere containing molecular oxygen" means a contact with a gas including an oxygen gas, preferably with air. The calcining time is preferably 0.5 to 10 hours, and more preferably 1 to 5 hours.

Examples of the platinum salt include chloroplatinic acid, tetraammineplatinum dinitrate, dinitroaminoplatinum, and tetraamminedichloroplatinum. Since chloride salts can produce hydrochloric acid during a reaction, which may cause apparatus corrosion, tetraammineplatinum dinitrate, which is a platinum salt that is not a chloride salt and in which a high level of platinum is dispersed, is preferred.

Examples of the palladium salt include palladium chloride, tetraammine palladium nitrate, and diaminopalladium nitrate. Since chloride salts can produce hydrochloric acid during a reaction, which may cause apparatus corrosion, tetraammine palladium nitrate, which is a palladium salt that is not a chloride salt and in which a high level of palladium is dispersed, is preferred.

The amount of the active metal supported on the carrier including zeolite according to the present aspect is preferably 0.001 to 20% by mass, and more preferably 0.01 to 5% by mass, based on the mass of the carrier. When the amount supported is below 0.001% by mass, it is difficult to impart a predetermined hydrogenation/dehydrogenation functions. Conversely, when the amount supported exceeds 20% by mass, conversion on the active metal of hydrocarbons into lighter products by cracking tends to easily proceed, so that the yield of the intended fraction tends to decrease, and further the catalyst costs tend to increase, hence not preferable.

Further, when the hydroisomerization dewaxing catalyst according to the present aspect is used for hydroisomerization of a hydrocarbon oil containing a large amount of sulfur-containing compounds and/or nitrogen-containing compounds, from the perspective of the durability of catalytic activity, it is preferred to include, as the active metals, a combination of nickel-cobalt, nickel-molybdenum, cobalt-molybdenum, nickel-molybdenum-cobalt, nickel-tungsten-cobalt, or the like. The amount of these metals supported is 0.001 to 50% by mass, and more preferably 0.01 to 30% by mass, based on the mass of the carrier.

In the present aspect, it is preferred to calcine the above catalyst precursor so that the organic template remaining in the carrier precursor remains. Specifically, it is preferred to set the heating conditions so that the carbon content of the obtained hydroisomerization dewaxing catalyst is 0.4 to 3.5% by mass (preferably 0.4 to 3.0% by mass, more preferably 0.4 to 2.5% by mass, and further preferably 0.4 to 1.5% by mass), or the micropore volume per unit mass of the obtained hydroisomerization dewaxing catalyst is 0.02 to 0.12 ml/g, and the micropore volume per unit mass of the zeolite contained in the catalyst is 0.01 to 0.12 ml/g.

Note that, in the present specification, the carbon content of the hydroisomerization dewaxing catalyst can be analyzed by a combustion in oxygen airflow—infrared absorption method. Specifically, using a carbon/sulfur analyzer (e.g., EMIA-920V, manufactured by HORIBA, Ltd.), the catalyst is combusted in an oxygen airflow and a carbon content is determined by quantification by an infrared absorption method.

The micropore volume per unit mass of the hydroisomerization dewaxing catalyst is calculated by a method called nitrogen adsorption measurement. Namely, for the catalyst, the micropore volume per unit mass of the catalyst is calculated by analyzing a physical adsorption and desorption isotherm of nitrogen measured at the temperature of liquid nitrogen (−196° C.), specifically, analyzing an adsorption isotherm of nitrogen measured at the temperature of liquid nitrogen (−196° C.) by a t-plot method. Further, the micropore volume per unit mass of the zeolite contained in the catalyst is also calculated by the above nitrogen adsorption measurement.

A micropore volume $V_z$ per unit mass of the zeolite contained in the catalyst can be calculated, for example, when the binder does not have a micropore volume, by the following formula from a value $V_c$ of the micropore volume per unit mass of the hydroisomerization dewaxing catalyst and the content percentage Mz (% by mass) of zeolite in the catalyst.

$$V_Z = V_c / M_z \times 100$$

It is preferred that, subsequent to the above calcination treatment, the hydroisomerization dewaxing catalyst of the present aspect is subjected to a reduction treatment after the catalyst is loaded in the reactor for conducting the hydroisomerization reaction. Specifically, it is preferred that the hydroisomerization dewaxing catalyst is subjected to the hydrogen reduction treatment for about 0.5 to 10 hours in an atmosphere containing molecular hydrogen, and preferably under a stream of hydrogen gas, preferably at 250 to 500° C., and more preferably 300 to 400° C. By performing this step, it can be further ensured that high activity for the dewaxing of the hydrocarbon oil can be imparted to the catalyst.

The hydroisomerization dewaxing catalyst according to the present aspect includes a carrier containing a zeolite having a 10-membered ring one dimensional pore structure, and a binder, and platinum and/or palladium supported on the carrier. In addition, the hydroisomerization dewaxing catalyst according to the present aspect is a catalyst, in which a carbon content is 0.4 to 3.5% by mass. Further, the hydroisomerization dewaxing catalyst of the present aspect is a hydroisomerization dewaxing catalyst having a micropore volume per unit mass of 0.02 to 0.12 ml/g, wherein the above zeolite derives from an ion-exchanged zeolite obtained by ion exchanging an organic template-containing zeolite containing an organic template and having a 10-membered ring one dimensional pore structure in a solution containing ammonium ions and/or protons and the micropore volume per unit mass of the zeolite contained in the catalyst may be 0.01 to 0.12 ml/g.

The hydroisomerization dewaxing catalyst of the present aspect can be produced by the method described above. The carbon content of the catalyst, the micropore volume per unit mass of the catalyst, and the micropore volume per unit mass of the zeolite contained in the catalyst can be set to be within the above-described ranges by appropriately adjusting the amount of ion-exchanged zeolite blended in the mixture including the ion-exchanged zeolite and a binder, the heating conditions of the mixture in an $N_2$ atmosphere, and the heating conditions of the catalyst precursor in the atmosphere containing molecular oxygen.

<Reaction Conditions for Dewaxing Step>

In the dewaxing step, the reaction temperature of the isomerization dewaxing is preferably 200 to 450° C., and more preferably 280 to 400° C. When the reaction temperature is less than 200° C., the isomerization of the normal paraffins contained in the base oil fraction does not easily proceed, so that the reduction and removal of the wax component tend to be insufficient. Conversely, when the reaction temperature exceeds 450° C., cracking of the base oil fraction is significant, so that the yield of the base oil for lubricant oils tends to decrease.

The reaction pressure of the isomerization dewaxing is preferably 0.1 to 20 MPa, and more preferably 0.5 to 15 MPa. When the reaction pressure is less than 0.1 MPa, catalyst degradation due to the formation of coke tends to be accelerated. Conversely, when the reaction pressure exceeds 20 MPa, construction costs for the apparatus increase, so that it tends to become difficult to realize an economical process.

In the isomerization dewaxing, the liquid hourly space velocity of the base oil fraction based on the catalyst is preferably 0.01 to 100 $h^{-1}$, and more preferably 0.1 to 50 $h^{-1}$. When the liquid hourly space velocity is below 0.01 $h^{-1}$, the cracking of the base oil fraction tends to proceed excessively, so that production efficiency tends to decrease. Conversely, when the liquid hourly space velocity exceeds 100 $h^{-1}$, the isomerization of the normal paraffins contained in the base oil fraction does not proceed easily, so that the reduction and removal of the wax component tend to be insufficient.

The supply ratio of hydrogen to base oil fraction in the isomerization dewaxing is preferably 100 to 1500 $Nm^3/m^3$, and more preferably 200 to 800 $Nm^3/m^3$. When the supply ratio is below 100 $Nm^3/m^3$, for example, in the case where the base oil fraction contains sulfur or nitrogen, hydrogen sulfide and ammonia gas produced by desulfurization and denitrification reactions that accompany the isomerization reaction adsorb onto and poison the active metal on the catalyst, which tends to make it difficult to achieve a predetermined catalytic performance. Conversely, when the supply ratio exceeds 1000 $Nm^3/m^3$, hydrogen supply equipment having an increased capacity is required, which tends to make it difficult to realize an economical process.

The dewaxed oil obtained in the dewaxing step has a normal paraffin concentration of preferably 10% by volume or less, and more preferably 1% by volume or less.

The dewaxed oil obtained in the dewaxing step of the present embodiment can be suitably used as the feedstock for the base oil for lubricant oils. In the present embodiment, the base oil for lubricant oils can be obtained by, for example, the hydrorefining step wherein the dewaxed oil obtained in the dewaxing step is hydrorefined to obtain a hydrorefined oil, and the second separation step wherein the hydrorefined oil is fractionated to obtain a base oil for lubricant oils.

(Hydrorefining Step)

In the hydrorefining step, the dewaxed oil obtained in the dewaxing step is hydrorefined to obtain a hydrorefined oil. By hydrorefining, for example, olefin and aromatic compounds in the dewaxed oil are hydrogenated, and the oxidation stability and a hue of the lubricant oil are improved. Further, the reduction of sulfur due to the hydrogenation of the sulfur compound in the dewaxed oil is expected.

The hydrorefining can be carried out by, in the presence of hydrogen, allowing the dewaxed oil to contact a hydrorefining catalyst. Examples of the hydrorefining catalyst include catalysts that comprise a carrier composed of one or more inorganic solid acidic substances selected from alumina, silica, zirconia, titania, boria, magnesia, and phosphorus, and one or more active metals, supported on the carrier, selected from the group consisting of platinum, palladium, nickel-molybdenum, nickel-tungsten, and nickel-cobalt-molybdenum.

A preferred carrier is an inorganic solid acidic substance that includes at least two or more of alumina, silica, zirconia, and titanic.

As the method for supporting the above active metals on the carrier, a conventional method such as impregnation or ion exchange may be employed.

The amount of the active metals supported in the hydrorefining catalyst is preferably such that the total amount of metal is 0.1 to 25% by mass relative to the carrier.

The average pore size of the hydrorefining catalyst is preferably 6 to 60 nm, and more preferably 7 to 30 nm. When the average pore size is less than 6 nm, a sufficient catalytic activity tends not to be obtained, whereas when the average pore size exceeds 60 nm, catalytic activity tends to decrease due to a decrease in the level of dispersion of the active metals.

It is preferred that the pore volume of the hydrorefining catalyst is 0.2 mL/g or more. If the pore volume is less than 0.2 mL/g, the activity degradation of the catalyst tends to occur earlier. Note that the pore volume of the hydrorefining catalyst may be, for example, 0.5 mL/g or less. In addition, it is preferred that the specific surface area of the hydrorefining catalyst is 200 $m^2/g$ or more. When the specific surface area of the catalyst is less than 200 $m^2/g$, the dispersibility of the active metals is insufficient, so that the activity tends to decrease. Note that the specific surface area of the hydrorefining catalyst may be, for example, 400 $m^2/g$ or less. The pore volume and the specific surface area of the catalyst can be measured and calculated by a method referred to BET method using nitrogen adsorption.

It is preferred that the reaction conditions for the hydrorefining are set to, for example, a reaction temperature of 200 to 300° C., a partial pressure of hydrogen of 3 to 20 MPa, an LHSV of 0.5 to 5 $h^{-1}$, and a hydrogen/oil ratio of 170 to 850 $Nm^3/m^3$, and more preferred are a reaction temperature of 200° C. to 300° C., a partial pressure of hydrogen of 4 to 18 MPa, an LHSV of 0.5 to 4 $h^{-1}$, and a hydrogen/oil ratio of 340 to 850 $Nm^3/m^3$.

In the present embodiment, it is preferred to adjust the reaction conditions so that sulfur and nitrogen in the hydrorefined oil is 5 ppm by mass or less and 1 ppm by mass or less, respectively. Note that sulfur is a value to be measured in conformity with JIS K2541 "Crude oil and petroleum products—Determination of sulfur content" and nitrogen is a value to be measured in conformity with JIS K2609 "Crude oil and petroleum products—Determination of nitrogen content".

(Second Separation Step)

In the second separation step, the hydrorefined oil is fractionated to obtain the base oil for lubricant oils.

The distillation conditions in the second separation step are not particularly limited as long as the conditions enable the fractionation of the hydrorefined oil into the lubricant oil fraction. For example, it is preferred that the second separation step be carried out by atmospheric distillation (or distillation under applied pressure) for distilling away the light fraction from the hydrorefined oil, and vacuum distillation for fractionating the bottom oil of the atmospheric distillation into the lubricant oil fraction.

In the second separation step, for example, several lubricant oil fractions are obtained by setting a plurality of cut points and performing vacuum distillation of the bottom oil obtained by the atmospheric distillation (or distillation under applied pressure) of the hydrorefined oil. In the second separation step, for example, the hydrorefined oil can be fractionated into the first lubricant oil fraction having a 10% by volume distillation temperature of 280° C. or more and a 90% by volume distillation temperature of 390° C. or less, the second lubricant oil fraction having a 10% by volume distillation temperature of 390° C. or more and a 90% by volume distillation temperature of 490° C. or less, and the third lubricant oil fraction having a 10% by volume distillation temperature of 490° C. or more and a 90% by volume distillation temperature of 530° C. or less, which are collected.

The first lubricant oil fraction can be obtained to be the base oil for lubricant oil suitable for an ATF and a shock absorber, and in this case, it is preferred that the desired value be set to be a kinematic viscosity at 100° C. of 2.7 $mm^2/s$. The second lubricant oil fraction can be obtained as the base oil for lubricant oils of the present invention suitable to be the base oil for engine oils satisfying the API Groups III and III+ standards, and in this case, it is preferred that the fraction have a kinematic viscosity at 100° C. 3.5 $mm^2/s$ or more and 4.5 $mm^2/s$ or less, and a pour point of −20° C. or less, when a kinematic viscosity at 100° C. of 4.0 $mm^2/s$ is set to be the desired value. The third lubricant oil fraction is the base oil for engine oils which satisfies the API Groups III and III+ standards, and can be obtained to be a base oil for lubricant oil suitable, for example, for a diesel engine, and in this case, it is preferred that, when a value higher than a kinematic viscosity at 40° C. of 32 $mm^2/s$ is set to be desirable, a kinematic viscosity at 100° C. be a value higher than 6.0 $mm^2/s$. Note that, in the present specification, the kinematic viscosities and the viscosity indexes at 40° C. or 100° C. are the values determined in conformity with JIS K2283 "Crude oil and petroleum products—Determination of kinematic viscosity and calculation of viscosity index from kinematic viscosity."

Note that the first lubricant oil fraction can be obtained as a base oil for lubricant oils equivalent to 70 Pale, the second lubricant oil fraction can be obtained as a base oil for lubricant oils equivalent to SAE-10, and the third lubricant oil fraction can be obtained as a base oil for lubricant oils equivalent to SAE-20. Note that the SAE viscosity means the standards stipulated by Society of Automotive Engineers. Further, the API standards are based on the classification of the lubricant oil grades set by API (American Petroleum Institute), and mean Group II (a viscosity index of 80 or more and below 120, and a saturated component of 90% by mass or more, and sulfur content of 0.03% by mass or less), Group III (a viscosity index of 120 or more, and a saturated component of 90% by mass or more, and sulfur content of 0.03% by mass or less), and Group III+ (a viscosity index of 140 or more, and a saturated component of 90% by mass, and sulfur content of 0.03% by mass or less).

Further, the hydrorefined oil obtained in the hydrorefining step includes light fractions such as naphtha and kerosene by-produced by the hydroisomerization and hydrocracking. In the second separation step, these light fractions can also be collected as fractions having, for example, a 90% by volume distillation temperature of 280° C. or less.

Note that, in the present embodiment, the base oil for lubricant oils can also be obtained by the second separation step wherein the dewaxed oil obtained in the dewaxing step is fractionated to obtain a lubricant oil fraction, and the hydrorefining step wherein the lubricant oil fraction is hydrorefined. During this operation, the second separation step and the hydrorefining step can be carried out in the same manner as in the second separation step and the hydrorefining step as described above.

Next, the preferred embodiments of the present invention are described with reference to the drawings.

FIG. 1 is a flow diagram showing an example of the apparatus for producing a base oil for lubricant oils to carry out the method for producing a base oil for lubricant oils of the present invention.

The apparatus for producing a base oil for lubricant oils 100 shown in FIG. 1 is structurally equipped with a first reactor 10 for hydrocracking the stock oil introduced from a flow channel L1; a first separator 20 for separating under high pressure (fractionating under applied pressure) the hydrocracked oil supplied through a flow channel L2 from the first reactor; a first vacuum distillation tower 21 for vacuum distillating the bottom oil supplied through a flow channel L3 from the first separator 20; a flow channel L5 for supplying a base oil fraction from the fractionation in the first vacuum distillation tower 21 to a subsequent step; a flow channel L6 for merging the heavy fraction from the fractionation in the first vacuum distillation tower 21 into the flow channel L1; a second reactor 30 for isomerization dewaxing the base oil fraction supplied from a flow channel L5; a third reactor 40 for hydrorefining the dewaxed oil supplied through a flow channel L7 from the second reactor 30; a second separator 50 for fractionating the hydrorefined oil supplied through a flow channel L8 from the third reactor 40; and a second vacuum distillation tower 51 for vacuum distillating the bottom oil supplied through a flow channel L9 from the second separator 50.

A hydrogen gas is supplied through a flow cannel L40 to the first reactor 10, the second reactor 30 and the third reactor 40.

The apparatus for producing a base oil for lubricant oils 100 is provided with a flow channel L31, branched off from the flow channel L40, connecting to the flow channel L1, and the hydrogen gas supplied from the flow channel L31 is mixed with the stock oil in the flow channel L1 and introduced to the first reactor 10. Further, a flow channel L32 branched off from the flow channel L40 is connected to the first reactor 10, and the hydrogen pressure and the catalyst bed temperature in the first reactor 10 are adjusted by the supply of the hydrogen gas from the flow channel L32.

The apparatus for producing a base oil for lubricant oils 100 is also provided with a flow channel L33, branched off from a flow channel L40, connecting to the flow channel L5, and the hydrogen gas supplied from the flow channel L33 is mixed with the base oil fraction in the flow channel L5 and introduced into the second reactor 30. Further, a flow channel L34 branched off from the flow channel L40 is connected to the second reactor 30, and the hydrogen pressure and the catalyst bed temperature in the second reactor 30 are adjusted by the supply of the hydrogen gas from the flow channel L34.

The apparatus for producing a base oil for lubricant oils 100 is further provided with a flow channel L35, branched off from the flow channel L40, connecting to the flow channel L7, and the hydrogen gas supplied from the flow channel L35 is mixed with the dewaxed oil in the flow channel L7 and introduced to the third reactor 40. Further, a flow channel L36 branched off from the flow channel L40 is connected to the third reactor 40, and the hydrogen pressure and the catalyst bed temperature in the third reactor 40 are adjusted by the supply of the hydrogen gas from the flow channel L36.

Note that the hydrogen gas passed through the second reactor 30 is removed together with the dewaxed oil via the flow channel L7 from the second reactor 30. For this reason, the amount of the hydrogen gas supplied from the flow channel L35 can suitably be adjusted in accordance with the amount of the hydrogen gas removed from the second reactor 30.

The first separator 20 is connected to the flow channel L4 for removing the light fractions lighter than the base oil fraction and the hydrogen gas from the system to outside. The mixed gas containing the light fractions and the hydrogen gas removed from the flow channel L4 is supplied to a first gas-liquid separator 60 and separated the light fractions from the hydrogen gas. The first gas-liquid separator 60 is connected to a flow channel L21 for removing the light fractions and a flow channel L22 for removing the hydrogen gas.

The second separator 50 is connected to the flow channel L10 for removing the light fractions lighter than the base oil for lubricant oils and the hydrogen gas from the system to outside. The mixed gas containing the light fractions and the hydrogen gas removed from the flow channel L10 is supplied to a second gas-liquid separator 70 and separated the light fractions from the hydrogen gas. The second gas-liquid separator 70 is connected to a flow channel L23 for removing the light fractions and a flow channel L24 for removing the hydrogen gas.

The hydrogen gas removed from the first gas-liquid separator 60 and the second gas-liquid separator 70 is supplied to an acid gas absorption tower 80 through the flow channel L22 and the flow channel L24. The hydrogen gas removed from the first gas-liquid separator 60 and the second gas-liquid separator 70 contains hydrogen sulfide, and the like, which is a hydride of sulfur, and the hydrogen sulfide is removed in the acid gas absorption tower 80. The hydrogen gas from which hydrogen sulfide, and the like, are removed in the acid gas absorption tower 80 is supplied to the flow channel L40 and introduced again to each of the reactors.

The second vacuum distillation tower 51 is provided with the flow channels L11, L12 and L13 for removing the lubricant oil fraction from the fractionation in accordance with the intended base oil for lubricant oil from the system to outside.

In the apparatus for producing a base oil for lubricant oils 100, the hydrocracking step can be carried out by hydrocracking the stock oil supplied from the flow channel L1 in the first reactor 10. In the first reactor 10, the hydrocracking can be carried out by allowing the stock oil to contact the hydrocracking catalyst in the presence of hydrogen (molecular hydrogen) supplied from the flow channel L31 and the flow channel L32.

The form of the first reactor 10 is not particularly limited, and a fixed bed reactor filled with the hydrocracking catalyst, for example, is preferably used. Note that, in the apparatus for producing a base oil for lubricant oils 100, the reactor for the hydrocracking is the first reactor 10 alone, but in the present embodiment the apparatus for producing a base oil for lubricant oils may be those wherein a plurality of reactors for hydrocracking are arranged in series or in parallel. Moreover, a catalyst bed in the reactor may be a single bed or a plurality of beds.

In the apparatus for producing a base oil for lubricant oils 100, the first separation step can be carried out by the first separator 20 and the first vacuum distillation tower 21.

In the first separator 20, the hydrocracked oil supplied from the flow channel L2 is separated under high pressure (fractionated under applied pressure) whereby the light fractions can be removed from the flow channel L4 and the bottom oil (base oil fraction and the heavy fraction) can be removed from the flow channel L3. Further, from the flow channel L2, the hydrogen gas passed through the first reactor 10 together with the hydrocracked oil is distributed to the first separator 20. In the first separator 20, the hydrogen gas together with the light fractions can be removed from the flow channel L4.

In the first vacuum distillation tower 21, the bottom oil supplied from the flow channel L3 is vacuum distilled, whereby the base oil fraction can be removed from the flow channel L5 and the heavy fraction can be removed from the flow channel L6. The flow channel L6 is connected to the flow channel L1, and the removed heavy fraction merges into the flow channel L1 and is recycled as the stock oil. Further, in the first vacuum distillation tower 21, the fraction lighter than the base oil fraction may be extracted from the flow channel L4' and merge into the flow channel L4.

Note that, in the apparatus for producing a base oil for lubricant oils 100, the first separation step is carried out by the first separator 20 and the first vacuum distillation tower 21, but can also be carried out by, for example, three or more distillation towers. Further, in the first vacuum distillation tower 21, the base oil fraction is removed as a single fraction but, in the production method according to the present embodiment the base oil fraction may be fractionated into 2 or more fractions and removed individually.

In the apparatus for producing a base oil for lubricant oils 100, the dewaxing step is carried out in the second reactor 30. In the second reactor 30, the base oil fraction supplied from the flow channel L5 is allowed to contact the hydroisomerization dewaxing catalyst in the presence of hydrogen (molecular hydrogen) supplied from the flow channel L33 and the flow channel L34. By this operation, the base oil fraction is dewaxed by the hydroisomerization.

The form of the second reactor 30 is not particularly limited, and a fixed bed reactor filled with the hydroisomerization dewaxing catalyst, for example, is preferably used. Note that, in the apparatus for producing a base oil for lubricant oils 100, the reactor for the isomerization dewaxing is the second reactor 30 alone, but in the present embodiment the apparatus for producing a base oil for lubricant oils may be those wherein a plurality of reactors for isomerization dewaxing are arranged in series or in parallel. Moreover, the catalyst bed in the reactor may be a single bed or a plurality of beds.

The dewaxed oil obtained via the second reactor 30 is supplied to the third reactor 40 via the flow channel L7 together with the hydrogen gas passed through the second reactor 30.

In the apparatus for producing a base oil for lubricant oils 100, the hydrorefining step is carried out in the third reactor 40. In the third reactor 40, the dewaxed oil supplied from the flow channel L7 is allowed to contact the hydrorefining catalyst in the presence of hydrogen (molecular hydrogen) supplied from the flow channel L7, the flow channel 35, and the flow channel L36, whereby the dewaxed oil is hydrorefined.

The form of the third reactor 40 is not particularly limited, and a fixed bed reactor filled with the hydrorefining catalyst, for example, is preferably used. Note that, in the apparatus for producing a base oil for lubricant oils 100, the reactor for the hydrorefining is the third reactor 40 alone, but in the present embodiment the apparatus for producing a base oil for lubricant oils may be those wherein a plurality of reactors for hydrorefining are arranged in series or in parallel. Moreover, the catalyst bed in the reactor may be a single bed or a plurality of beds.

The hydrorefined oil obtained via the third reactor 40 is supplied to the second separator 50 via the flow channel L8 together with the hydrogen gas passed through the third reactor 40.

In the apparatus for producing a base oil for lubricant oils 100, the second separation step can be carried out by the second separator 50 and the second vacuum distillation tower 51.

In the second separator 50, the hydrorefined oil supplied from the flow channel L8 is separated under high pressure (fractionated under applied pressure) whereby the fraction (e.g., naphtha and fuel oil fractions) lighter than the fraction useful to be a base oil for lubricant oils can be removed from the flow channel L10 and the bottom oil can be removed from the flow channel L9. Further, from the flow channel L8, the hydrogen gas passed through, together with the hydrorefined oil, the third reactor 40 is distributed but in the second separator 50, the hydrogen gas together with the light fractions can be removed from the flow channel L10.

In the second vacuum distillation tower 51, the bottom oil supplied from the flow channel L9 is vacuum distillated, whereby the lubricant oil fraction can be removed from the flow channel L11, the flow channel L12 and the flow channel L13, and the lubricant oil fractions removed from each of the flow channels can be preferably used to be the base oil for lubricant oils. Further, in the second vacuum distillation tower 51, the fraction lighter than the lubricant oil fraction may be extracted from the flow channel L10' and merged into the flow channel L10.

Note that, in the apparatus for producing a base oil for lubricant oils 100, the second separation step is carried out by the second separator 50 and the second vacuum distillation tower 51, but can also be carried out by, for example, three or more distillation towers. Further, in the second vacuum distillation tower 51, three fractions are removed to be the lubricant oil fractions by the fractionation, but, in the production method according to the present embodiment, a single fraction may be removed as a lubricant oil fraction by the fractionation, and 2 fractions or 4 or more fractions can be removed as lubricant oil fractions by the fractionation.

In the apparatus for producing a base oil for lubricant oils 100, the hydrocracking is carried out in the first reactor 10 so that a crack per mass of the heavy matter is 20 to 85% by mass. At this operation, sulfur contained in the stock oil is hydrogenated and hydrogen sulfide may be produced. More specifically, the hydrogen gas passed through the first reactor 10 may contain hydrogen sulfide.

When the hydrogen gas containing hydrogen sulfide from passing through the first reactor 10 is directly returned back to the flow channel L40, the hydrogen gas containing hydrogen sulfide is supplied to the second reactor 30 and the catalytic activity of the second reactor 30 decreases. For this reason, in the apparatus for producing a base oil for lubricant oils 100, the hydrogen gas passed through the first reactor 10 is supplied to the acid gas absorption tower 80 via the flow channel L2, the first separator 20, the flow channel L4, the first gas-liquid separator 60 and the flow channel L22, hydrogen sulfide is removed at the acid gas absorption tower 80, and subsequently the hydrogen gas is returned to the flow channel L40.

Further, in the apparatus for producing a base oil for lubricant oils 100, the hydrogen gas passed through the second reactor 30 and the third reactor 40 may also sometimes contain hydrogen sulfide produced from sulfur contained in a small amount in the base oil fraction, and thus is supplied to the acid gas absorption tower 80 through the flow channel L24, and subsequently returned to the flow channel L40.

In the apparatus for producing a base oil for lubricant oils 100, the hydrogen gas is circulated via the acid gas absorption tower 80 as described above, but, in the present embodiment, the hydrogen gas does not necessarily need to be circulated and may be each individually supplied to each of the reactors.

Further, the apparatus for producing a base oil for lubricant oils 100 may be provided with a waste water treatment equipment at the previous step or subsequent step of the acid gas absorption tower 80 for removing ammonia, and the like, produced by the hydrogenation of nitrogen contained in the stock oil. Ammonia is treated in the waste water treatment equipment as mixed in the stripping steam, converted to NOx with sulfur at a sulfur recovery and subsequently returned to nitrogen by the denitration reaction.

Hereinabove, the preferred embodiments of the present invention are described but the present invention is not particularly limited to the above embodiments. For example, an aspect of the present invention is the production apparatus for carrying out the production method according to the present embodiment, and another aspect of the present invention relates to a base oil for lubricant oils obtained by the production method of the present embodiment.

EXAMPLES

Hereinafter, the present invention is described further in detail with reference to Examples, but is not particularly limited thereto.

Production Example 1

Preparation of Hydrocracking Catalyst a

Water was added to a mixture of 50% by mass of silica zirconia and 50% by mass of alumina binder and kneaded to a clay state to prepare a kneaded product. The kneaded product was extrusion molded, dried, and calcined to prepare a carrier. 5% by weight of a nickel oxide, 20% by weight of a molybdenum oxide and 3% by mass of a phosphorus oxide were supported on the carrier by the impregnation method to obtain a hydrocracking catalyst a.

Production Example 2

Preparation of Hydroisomerization Dewaxing Catalyst b

<Production of ZSM-22 Zeolite>

ZSM-22 zeolite (hereinafter, in some cases, referred to as "ZSM-22") composed of crystalline aluminosilicate having an Si/Al ratio of 45 was produced by hydrothermal synthesis in the following procedure. First, the following four types of aqueous solutions were prepared.

Solution A: A solution prepared by dissolving 1.94 g of potassium hydroxide in 6.75 mL of ion-exchanged water.

Solution B: A solution prepared by dissolving 1.33 g of aluminum sulfate 18-hydrate in 5 mL of ion-exchanged water.

Solution C: A solution prepared by diluting 4.18 g of 1,6-hexanediamine (an organic template) with 32.5 mL of ion-exchanged water.

Solution D: A solution prepared by diluting 18 g of colloidal silica (Ludox AS-40 by Grace Davison) with 31 mL of ion-exchanged water.

Next, Solution A was added to Solution B, and the mixture was stirred until the aluminum component completely dissolved. After Solution C was added to this mixed solution, the mixture of Solutions A, B, and C was poured into Solution D with vigorously stirring at room temperature. Further, to the resulting mixture was further added, as a "seed crystal" that promotes crystallization, 0.25 g of a powder of ZSM-22 that had been separately synthesized, and had not been subjected to any special treatment after the synthesis, thereby obtaining a gel.

The gel obtained by the above procedure was transferred into a 120 mL internal volume stainless steel autoclave reactor, and the autoclave reactor was rotated at a rotational speed of about 60 rpm on a tumbling apparatus for 60 hours in an oven at 150° C., causing a hydrothermal synthesis reaction to take place. After the completion of the reaction, the reactor was opened after cooling, and dried overnight in a drier at 60° C., thereby obtaining ZSM-22 having an Si/Al ratio of 45.

<Ion Exchange of ZSM-22 Containing an Organic Template>

ZSM-22 obtained in the above was subjected to ion exchange treatment in an aqueous solution containing ammonium ion by the following procedure.

ZSM-22 obtained in the above was taken in a flask, and 100 mL of 0.5 N-ammonium chloride aqueous solution per gram of the ZSM-22 zeolite was added thereto, and the mixture was heated under reflux for 6 hours. After cooling the mixture to room temperature, the supernatant was removed, and the crystalline aluminosilicate was washed with ion-exchanged water. To the resulting product, the same amount of 0.5 N-ammonium chloride aqueous solution as above was added again, and the mixture was heated under reflux for 12 hours.

Then, the solid content was extracted by filtration, washed with ion-exchanged water, and dried overnight in a drier at 60° C., thereby obtaining ion-exchanged $NH_4$ form ZSM-22. The ZSM-22 is a zeolite, which is ion exchanged while containing the organic template therein.

<Binder Blending, Molding, and Calcination)

The $NH_4$ ZSM-22 obtained in the above was mixed with alumina, i.e., a binder, in a mass ratio of 7:3, a small amount of ion-exchanged water was added thereto, and the mixture was kneaded. The obtained viscous fluid was loaded in an extruder and molded into a cylindrical molded product having a diameter of about 1.6 mm and a length of about 10 mm, thereby obtaining a molded product. This molded product was heated under nitrogen atmosphere for 3 hours at 300° C., thereby obtaining a carrier precursor.

<Support of Platinum and Calcination>

Tetraamminedinitroplatinum$[Pt(NH_3)_4](NO_3)_2$ was dissolved in ion-exchanged water in an amount equivalent to the water absorption amount measured in advance of a carrier precursor, thus obtaining an impregnation solution. This solution was impregnated in the above carrier precursor by incipient wetting method, and support of platinum was carried out so that an amount of platinum was 0.3% by mass relative to the mass of the ZSM-22 zeolite. Next, the obtained impregnation product (catalyst precursor) was dried overnight in a drier at 60° C., and then calcined under an air stream for 3 hours at 400° C., thereby obtaining a hydroisomerization dewaxing catalyst b having a carbon content of 0.56% by mass. Note that the carbon content of the hydroisomerization catalyst was analyzed by a combustion in oxygen airflow—infrared absorption method (measurement instrument: HORIBA, Ltd., EMIA-920V). Specifically, the catalyst b was combusted in oxygen airflow and a carbon content was quantitatively determined by the infrared absorption method.

Further, the micropore volume per unit mass of the obtained hydroisomerization dewaxing catalyst was calculated by the following method. To remove the moisture adsorbed to the hydroisomerization dewaxing catalyst, the pretreatment of vacuum pumping was first carried out at 150° C. for 5 hours. The adsorption/desorption isotherm of the pretreated hydroisomerization dewaxing catalyst was automatically measured by the nitrogen constant-volume gas adsorption method at the liquid nitrogen temperature (−196° C.) using a BEL Japan, Inc. BELSORP-max. For the data analysis using an analysis software (BEL Master™) attached to the instrument, the measured nitrogen absorption/desorption isotherm was automatically analyzed by t-plot method, and the micropore volume (ml/g) per unit mass of the hydroisomerization dewaxing catalyst was calculated.

Further, the micropore volume per unit mass of the zeolite contained in the catalyst $V_Z$ was calculated by the following formula. Additionally, the alumina used as the binder was subjected to the nitrogen adsorption measurement in the same manner as above and was confirmed not to have a micropore.

$$V_Z = V_c / M_z \times 100$$

In the formula, $V_c$ represents the micropore volume per unit mass of the hydroisomerization dewaxing catalyst, and $M_z$ represents the content percentage (% by mass) of the zeolite contained in the catalyst.

The micropore volume per unit mass of the hydroisomerization dewaxing catalyst b was 0.055 ml/g, and the micropore volume per unit mass of the zeolite contained in the catalyst was 0.079 ml/g.

Production Example 3

Hydrorefining Catalyst c

Water was added to a mixture of 50% by mass of silica zirconia and 50% by mass of alumina binder and kneaded to a clay state to prepare a kneaded product. The kneaded product was extrusion molded, dried, and calcined to prepare a carrier. 0.3% by weight of platinum and 0.3% by weight of palladium were supported on the carrier by the impregnation method to obtain a hydrorefining catalyst c.

Example A1

Hereafter, Examples are illustrated with reference to the apparatus for producing a base oil for lubricant oils 100 shown in the FIG. 1.

In Example 1, slack wax 1 shown in Table 1 was used as a fresh feed (hereinafter referred to as "FF" in some cases), and hydrocracked at a reaction temperature of 382° C., a partial pressure of hydrogen of 11 MPa, an liquid hourly space velocity (LHSV) of 0.5 $h^{-1}$, and a hydrogen/oil ratio of 844 $Nm^3/m^3$. For the hydrocracking catalyst, the hydrocracking catalyst a was used, and the crack per mass under this hydrocracking conditions was 67%.

The obtained hydrocracked oil was fractionated, using a high-temperature and high-pressure separator (the first separator 20), into the fractions having a boiling point of 290° C. or less (light fractions) and fractions having a higher boiling point than that (bottom oils). The light fractions were separated in the gas-liquid separator (the first gas-liquid separator 60) into a gas component mainly containing the hydrogen gas and a liquid fraction (cracked oil), the gas component was guided to the acid gas absorption tower (the acid gas absorption tower 80) at which impurities such as hydrogen sulfide and ammonia were absorbed and removed to obtain the hydrogen gas, which was then suitably mixed with a fresh hydrogen gas and introduced to the hydrocracking reaction tower (the first reactor 10), the isomerization reaction tower (the second reactor 30), and the hydrofinishing reaction tower (the third reactor 40).

On the other hand, the bottom oil was fractionated, by the vacuum distillation, into the fractions having a boiling point of 530° C. or less (base oil fraction) and the fractions having higher boiling point than that (heavy fractions). The heavy fractions (hereinafter, in some cases, referred to as "RF") was recycled and mixed with slack wax 1 (slack wax 1:heavy fraction=33:67 (mass ratio)) and supplied to the hydrocracking reaction tower. More specifically, in Example 1, the mixture of slack wax 1 and the heavy fraction (hereinafter, in some cases, referred to as "CF") was used as the stock oil except at the time of starting.

Subsequently, the base oil fraction (hereinafter, in some cases, referred to as "LF") was isomerization dewaxed under the conditions of a reaction temperature of 300° C., a partial pressure of hydrogen of 5.5 MPa, a liquid hourly space velocity of 1 $h^{-1}$, and a hydrogen/oil ratio of 505 $Nm^3/m^3$ to obtain a dewaxed oil. For the hydroisomerization dewaxing catalyst, the hydroisomerization dewaxing catalyst b was used. Next, the dewaxed oil was hydrorefined under the conditions of a reaction temperature of 223° C., a partial pressure of hydrogen of 5 MPa, a liquid hourly space velocity of 1.5 $h^{-1}$, and a hydrogen/oil ratio of 505 $Nm^3/m^3$ to obtain a hydrorefined oil. For the hydrorefining catalyst, the hydrorefining catalyst c was used. The hydrorefined oil was fractionated, in the distillation towers (the high-temperature and high-pressure separator (the second separator 50) and the second vacuum distillation tower 51), into a base oil for lubricant oils 1 having a 10% by volume distillation temperature of 280° C. or more and a 90% by volume distillation temperature of 390° C. or less, a base oil for lubricant oils 2 having a 10% by volume distillation temperature of 390° C. or more and a 90% by volume distillation temperature of 490° C. or less, and a base oil for lubricant oils 3 having a 10% by volume distillation temperature of 490° C. or more and a 90% by volume distillation temperature of 530° C. or less, thereby obtaining the base oils for lubricant oils 1 to 3. Under these processing conditions, the operation was continuously run for 200 hours, and the characteristics and yield of each of the base oil for lubricant oils were determined.

Table 1 shows the characteristics of slack wax 1 (FF characteristics), and table 2 shows the characteristics of the stock oil (CF), which is a mixture of slack wax 1 (FF) and the heavy fraction (RF). Further, Table 4 shows the hydrocracking conditions and the characteristics of the obtained base oil fractions (LF). Further, Table 6 shows the hydroisomerization conditions and the hydrorefining conditions. Furthermore, Table 8 shows the characteristics of the base oils for lubricant oils and the yield of each of the base oils for lubricant oils.

Note that, in the Tables, the term "LF/FF selectivity" shows the ratio (% by mass) of the total amount of the obtained base oil fraction (LF) to the total amount of the fresh feed (FF) supplied per unit time to the hydrogenation reaction tower. Further, the term "yield based on LF" in each of the base oils of lubricant oils shows the ratio (% by mass) of the total amount of the base oils for lubricant oils to the total amount of the base oil fractions (LF) subjected to the hydroisomerization dewaxing per unit time; the term "total yield 1" shows the ratio (% by mass) of the total amount of the obtained base oils for lubricant oils 1 to 3 to the total amount of the stock oil (CF) supplied to the hydrocracking reaction tower per unit time; and the term "total yield 2" shows the ratio (% by mass) of the total amount of the obtained base oils for lubricant oils 1 to 3 to the total amount of the fresh feed (FF) supplied to the process per unit time.

Examples A2 to A5, Comparative Examples a1 to a2

The 200-hour continuous process was carried out in the same manner as in Example A1, except that the FF/RF ratio in the stock oil (CF), the hydrocracking conditions, the hydroisomerization conditions and the hydrorefining conditions were changed as described in Tables 2 to 7. The characteristics of the obtained base oils for lubricant oils 1 to 3 and the yield of each of the base oils for lubricant oils are as described in Tables 8 and 9.

TABLE 1

| | Slack wax 1 |
|---|---|
| T10 (° C.) | 528 |
| T90 (° C.) | 670 |
| Density @ 15° C. ($g/cm^3$) | 0.9087 |
| 100° C. Kinematic viscosity ($mm^2/s$) | 21.1 |
| Sulfur (% by mass) | 0.21 |
| Nitrogen (ppm by mass) | 53 |
| C30 or more (% by mass) | 99.8 |
| C30-60 (% by mass) | 79.9 |

Note that, in Table, the terms "T10(° C.)" and "T90(° C.)" show the values at a 10% by volume distillation temperature and a 90% by volume distillation temperature measured in conformity with JIS K2254 "Petroleum products—Determination of distillation characteristics—Gas chromatograph system." Further, the term "Density @ 15° C. ($g/cm^3$)" shows the value of the density at 15° C. measured in conformity with JIS K2254 "Crude oil and petroleum products—Determination of density, mass and volume conversion table." Furthermore, the term "100° C. Kinematic viscosity ($mm^2/s$)" shows the value of a kinematic viscosity at 100° C. measured in conformity with JIS K2283 "Crude oil and petroleum products—Determination of kinematic viscosity and calculation of viscosity index from kinematic viscosity." Still furthermore, the term "Sulfur (% by mass)" shows a content of sulfur measured in conformity with JIS K2541 "Crude oil and petroleum products—Determination of Sulfur Content." Also, the term "Nitrogen (ppm by mass) shows a content of nitrogen measured in conformity with JIS K2609 "Crude petroleum and petroleum products—Determination of nitrogen content." Further, the terms "C30 or more (% by mass)" and "C30-60 (% by mass)" show the content percentage of the hydrocarbon having 30 or more carbon atoms and the content percentage of hydrocarbon having 30 to 60 carbon atoms, which were determined based on the component analysis results separated and quantified using a Shimadzu gas chromatograph GC-2010, on which a non-polar column (Ultra Alloy—1HT (30 m×0.25 mmφ) and an FID (flame ionization detector) were mounted.

TABLE 5

| | | Comparative Example a1 | Comparative Example a2 |
|---|---|---|---|
| Hydrocracking conditions | Reaction temperature (° C.) | 365 | 386 |
| | Partial pressure of hydrogen (MPa) | 11 | 2 |
| | LHSV ($h^{-1}$) | 0.1 | 0.5 |
| | Hydrogen oil ratio ($Nm^3/m^3$) | 844 | 844 |
| | Crack per mass (% by mass) | 88 | 65 |
| | Recycle rate (% by mass) | 12 | 35 |
| Base oil fraction characteristics | 100° C. Kinematic viscosity ($mm^2/s$) | 5.75 | 4.65 |
| | Sulfur (ppm by mass) | 2 | 2 |
| | LF/FF Selectivity (% by mass) | 46 | 65 |

TABLE 2

| | | Example A1 | Example A2 | Example A3 | Example A4 | Example A5 |
|---|---|---|---|---|---|---|
| CF Characteristics | FF | Slack wax 1 | Slack wax 1 | Slack wax 1 | Slack wax 1 | Slack wax 1 |
| | FF/RF Ratio | 33/67 | 55/45 | 20/80 | 36/64 | 72/28 |
| | Density @ 15° C. ($g/cm^3$) | 0.9081 | 0.9083 | 0.9080 | 0.9081 | 0.9084 |
| | 100° C. Kinematic viscosity ($mm^2/s$) | 20.7 | 20.5 | 20.9 | 20.7 | 20.3 |
| | Sulfur (% by mass) | 0.07 | 0.12 | 0.04 | 0.08 | 0.15 |
| | Nitrogen (ppm by mass) | 17 | 29 | 11 | 19 | 38 |
| | C30 or more (% by mass) | 98.8 | 99.2 | 98.6 | 98.8 | 99.4 |
| | C30-60 (% by mass) | 79.1 | 79.4 | 78.9 | 79.1 | 79.6 |

TABLE 3

| | | Comparative Example a1 | Comparative Example a2 |
|---|---|---|---|
| CF Characteristics | FF | Slack wax 1 | Slack wax 1 |
| | FF/RF Ratio | 12/88 | 35/65 |
| | Density @ 15° C. ($g/cm^3$) | 0.9079 | 0.9081 |
| | 100° C. Kinematic viscosity ($mm^2/s$) | 21.0 | 20.7 |
| | Sulfur (% by mass) | 0.03 | 0.07 |
| | Nitrogen (ppm by mass) | 6 | 19 |
| | C30 or more (% by mass) | 98.4 | 98.8 |
| | C30-60 (% by mass) | 78.8 | 79.1 |

TABLE 4

| | | Example A1 | Example A2 | Example A3 | Example A4 | Example A5 |
|---|---|---|---|---|---|---|
| Hydrocracking conditions | Reaction temperature (° C.) | 382 | 371 | 381 | 385 | 374 |
| | Partial pressure of hydrogen (MPa) | 11 | 11 | 11 | 5.5 | 17 |
| | LHSV ($h^{-1}$) | 0.5 | 0.5 | 0.3 | 0.5 | 1.5 |
| | Hydrogen oil ratio ($Nm^3/m^3$) | 844 | 844 | 844 | 844 | 844 |
| | Crack per mass (% by mass) | 67 | 45 | 80 | 64 | 28 |
| | Recycle rate (% by mass) | 33 | 55 | 20 | 36 | 72 |
| Base oil fraction characteristics | 100° C. Kinematic viscosity ($mm^2/s$) | 4.51 | 6.61 | 4.82 | 5.04 | 4.76 |
| | Sulfur (ppm by mass) | 4 | 3 | 3 | 4 | 3 |
| | LF/FF Selectivity (% by mass) | 61 | 69 | 55 | 55 | 84 |

TABLE 6

| | | Example A1 | Example A2 | Example A3 | Example A4 | Example A5 |
|---|---|---|---|---|---|---|
| Hydroisomerization conditions | Reaction temperature (° C.) | 300 | 315 | 286 | 311 | 289 |
| | Partial pressure of hydrogen (MPa) | 5.5 | 5.5 | 5.5 | 5.5 | 5.5 |
| | LHSV ($h^{-1}$) | 1 | 1 | 1 | 1 | 1 |
| | Hydrogen oil ratio ($Nm^3/m^3$) | 505 | 505 | 505 | 505 | 505 |
| Hydrorefining conditions | Reaction temperature (° C.) | 223 | 224 | 224 | 225 | 224 |
| | Partial pressure of hydrogen (MPa) | 5 | 5 | 5 | 5 | 5 |
| | LHSV ($h^{-1}$) | 1.5 | 1.5 | 1.5 | 1.5 | 1.5 |
| | Hydrogen oil ratio ($Nm^3/m^3$) | 505 | 505 | 505 | 505 | 505 |

TABLE 7

| | | Comparative Example a1 | Comparative Example a2 |
|---|---|---|---|
| Hydroisomerization conditions | Reaction (° C.) temperature | 275 | 316 |
| | Partial pressure of hydrogen (MPa) | 5.5 | 5.5 |
| | LHSV ($h^{-1}$) | 1 | 1 |
| | Hydrogen oil ratio ($Nm^3/m^3$) | 505 | 505 |
| Hydrorefining conditions | Reaction temperature (° C.) | 224 | 224 |
| | Partial pressure of hydrogen (MPa) | 5 | 5 |
| | LHSV ($h^{-1}$) | 1.5 | 1.5 |
| | Hydrogen oil ratio ($Nm^3/m^3$) | 505 | 505 |

TABLE 9

| | | Comparative Example a1 | Comparative Example a2 |
|---|---|---|---|
| Base oil for lubricant oils 1 | Yield based on LF (%) | 8.5 | 12.1 |
| | 100° C. Kinematic viscosity ($mm^2/s$) | 2.42 | 2.49 |
| | Viscosity index | 113 | 110 |
| | Pour point (° C.) | −17.5 | −10 |
| Base oil for lubricant oils 2 | Yield based on LF (%) | 13.1 | 18.6 |
| | 100° C. Kinematic viscosity ($mm^2/s$) | 4.17 | 4.3 |
| | Viscosity index | 139 | 115 |
| | Pour point (° C.) | −20 | −20 |
| Base oil for lubricant oils 3 | Yield based on LF (%) | 8.5 | 12.0 |
| | 100° C. Kinematic viscosity ($mm^2/s$) | 6.53 | 6.47 |
| | Viscosity index | 147 | 131 |
| | Pour point (° C.) | 2.5 | −30 |

TABLE 8

| | | Example A1 | Example A2 | Example A3 | Example A4 | Example A5 |
|---|---|---|---|---|---|---|
| Base oil for lubricant oils 1 | Yield based on LF (%) | 15.0 | 5.5 | 10.2 | 10.2 | 15.6 |
| | 100° C. Kinematic viscosity ($mm^2/s$) | 2.42 | 2.61 | 2.45 | 2.51 | 2.47 |
| | Viscosity index | 114 | 113 | 119 | 117 | 113 |
| | Pour point (° C.) | −15 | 2.5 | 5 | 17.5 | 2.5 |
| Base oil for lubricant oils 2 | Yield based on LF (%) | 23.1 | 22.6 | 15.7 | 15.7 | 24.0 |
| | 100° C. Kinematic viscosity ($mm^2/s$) | 4.16 | 4.31 | 4.12 | 4.26 | 4.18 |
| | Viscosity index | 130 | 121 | 135 | 124 | 120 |
| | Pour point (° C.) | −25 | −27.5 | −20 | −20 | −20 |
| Base oil for lubricant oils 3 | Yield based on LF (%) | 14.9 | 5.7 | 10.1 | 10.1 | 15.5 |
| | 100° C. Kinematic viscosity ($mm^2/s$) | 6.43 | 6.45 | 6.51 | 6.53 | 6.48 |
| | Viscosity index | 140 | 133 | 146 | 136 | 132 |
| | Pour point (° C.) | −25 | −32.5 | 0 | −20 | −35 |
| Total yield 1 (ratio based on CF (RF + FF)) (%) | | 21.7 | 10.5 | 15.9 | 12.7 | 12.9 |
| Total yield 2 (ratio based on FF) (%) | | 32.3 | 23.3 | 19.8 | 19.8 | 46.2 |

Note that, in Table, the terms "100° C. Kinematic viscosity ($mm^2/s$) and "Viscosity index" show the value of kinematic viscosity at 100° C. and the value of viscosity index, which were measured in conformity with JIS K2283 "Crude petroleum and petroleum products—Determination of kinematic viscosity and calculation of viscosity index from kinematic viscosity." Further, the term "Pour point (° C.)" shows the value of a pour point measured in conformity with JIS K2269 "Testing Methods for Pour Point and Cloud Point of Crude Oil and Petroleum Products."

TABLE 9-continued

| | Comparative Example a1 | Comparative Example a2 |
|---|---|---|
| Total yield 1 (ratio based on CF (RF + FF)) (%) | 12.2 | 18.0 |
| Total yield 2 (ratio based on FF) (%) | 13.9 | 27.7 |

Examples B1 to B4 and Comparative Examples b1 and b2

The 200-hour continuous process was carried out in the same manner as in Example A1, except that slack wax 1 was changed to slack wax 2 described in Table 10 and the FF/RF ratio in the crude oil (CF), the hydrocracking conditions, the hydroisomerization conditions and the hydrorefining conditions were as described in Tables 11 to 16. The characteristics of the obtained base oils for lubricant oils 1 to 3 and the yield of each of the base oils for lubricant oils are as described in Tables 17 and 18.

TABLE 10

| | Slack wax 2 |
|---|---|
| T10 (° C.) | 458 |
| T90 (° C.) | 552 |
| Density @ 150° C. (g/cm$^3$) | 0.8523 |
| 100° C. Kinematic viscosity (mm$^2$/s) | 8.0 |
| Sulfur (% by mass) | 0.18 |
| Nitrogen (ppm by mass) | 41 |
| C30 or more (% by mass) | 94.8 |
| C30-60 (% by mass) | 94.5 |

TABLE 14

| | | Comparative Example b1 | Comparative Example b2 |
|---|---|---|---|
| Hydrocracking conditions | Reaction temperature (° C.) | 360 | 404 |
| | Partial pressure of hydrogen (MPa) | 11 | 2 |
| | LHSV (h$^{-1}$) | 0.5 | 0.5 |
| | Hydrogen oil ratio (Nm$^3$/m$^3$) | 844 | 844 |
| | Crack per mass (% by mass) | 18 | 85 |
| | Recycle rate (% by mass) | 82 | 15 |
| Base oil fraction characteristics | 100° C. Kinematic viscosity (mm$^2$/s) | 5.16 | 5.13 |
| | Sulfur (ppm by mass) | 5 | 2 |
| | LF/FF Selectivity (% by mass) | 74 | 42 |

TABLE 11

| | | Example B1 | Example B2 | Example B3 | Example B4 |
|---|---|---|---|---|---|
| CF Characteristics | FF | Slack wax 2 | Slack wax 2 | Slack wax 2 | Slack wax 2 |
| | FF/RF Ratio | 71/29 | 43/57 | 77/23 | 24/76 |
| | Density @ 15° C. (g/cm$^3$) | 0.8521 | 0.8520 | 0.8522 | 0.8518 |
| | 100° C. Kinematic viscosity (mm$^2$/s) | 7.3 | 7.6 | 7.2 | 7.8 |
| | Sulfur (% by mass) | 0.13 | 0.08 | 0.14 | 0.04 |
| | Nitrogen (ppm by mass) | 29 | 18 | 32 | 10 |
| | C30 or more (% by mass) | 94.5 | 94.3 | 94.6 | 94.1 |
| | C30-60 (% by mass) | 94.2 | 94.0 | 94.3 | 93.8 |

TABLE 12

| | | Comparative Example b1 | Comparative Example b2 |
|---|---|---|---|
| CF Characteristics | FF | Slack wax 2 | Slack wax 2 |
| | FF/RF Ratio | 18/82 | 85/15 |
| | Density @ 15° C. (g/cm$^3$) | 0.8518 | 0.8522 |
| | 100° C. Kinematic viscosity (mm$^2$/s) | 7.8 | 7.2 |
| | Sulfur (% by mass) | 0.03 | 0.15 |
| | Nitrogen (ppm by mass) | 7 | 35 |
| | C30 or more (% by mass) | 94.0 | 94.7 |
| | C30-60 (% by mass) | 93.7 | 94.4 |

TABLE 13

| | | Example B1 | Example B2 | Example B3 | Example B4 |
|---|---|---|---|---|---|
| Hydrocracking conditions | Reaction temperature (° C.) | 391 | 383 | 397 | 367 |
| | Partial pressure of hydrogen (MPa) | 11 | 11 | 5.5 | 17 |
| | LHSV (h$^{-1}$) | 0.5 | 0.5 | 0.5 | 0.5 |
| | Hydrogen oil ratio (Nm$^3$/m$^3$) | 844 | 844 | 844 | 844 |
| | Crack per mass (% by mass) | 71 | 43 | 77 | 24 |
| | Recycle rate (% by mass) | 29 | 57 | 23 | 76 |
| Base oil fraction characteristics | 100° C. Kinematic viscosity (mm$^2$/s) | 4.89 | 5.31 | 4.79 | 4.92 |
| | Sulfur (ppm by mass) | 3 | 2 | 6 | 3 |
| | LF/FF Selectivity (% by mass) | 58 | 67 | 49 | 79 |

TABLE 15

| | | Example B1 | Example B2 | Example B3 | Example B4 |
|---|---|---|---|---|---|
| Hydroisomerization conditions | Reaction temperature (° C.) | 298 | 311 | 282 | 286 |
| | Partial pressure of hydrogen (MPa) | 5.5 | 5.5 | 5.5 | 5.5 |
| | LHSV ($h^{-1}$) | 1 | 1 | 1 | 1 |
| | Hydrogen oil ratio ($Nm^3/m^3$) | 505 | 505 | 505 | 505 |
| Hydrorefining conditions | Reaction temperature(° C.) | 223 | 223 | 224 | 223 |
| | Partial pressure of hydrogen (MPa) | 5 | 5 | 5 | 5 |
| | LHSV ($h^{-1}$) | 1.5 | 1.5 | 1.5 | 1.5 |
| | Hydrogen oil ratio ($Nm^3/m^3$) | 505 | 505 | 505 | 505 |

TABLE 16

| | | Comparative Example b1 | Comparative Example b2 |
|---|---|---|---|
| Hydroisomerization conditions | Reaction temperature (° C.) | 320 | 272 |
| | Partial pressure of hydrogen (MPa) | 5.5 | 5.5 |
| | LHSV ($h^{-1}$) | 1 | 1 |
| | Hydrogen oil ratio ($Nm^3/m^3$) | 505 | 505 |
| Hydrorefining conditions | Reaction temperature (° C.) | 224 | 223 |
| | Partial pressure of hydrogen (MPa) | 5 | 5 |
| | LHSV ($h^{-1}$) | 1.5 | 1.5 |
| | Hydrogen oil ratio ($Nm^3/m^3$) | 505 | 505 |

TABLE 17

| | | Example B1 | Example B2 | Example B3 | Example B4 |
|---|---|---|---|---|---|
| Base oil for lubricant oils 1 | Yield based on LF (%) | 12.0 | 4.4 | 7.2 | 11.6 |
| | 100° C. Kinematic viscosity ($mm^2/s$) | 2.61 | 2.51 | 2.68 | 2.56 |
| | Viscosity index | 117 | 116 | 115 | 116 |
| | Pour point (° C.) | −15 | 2.5 | −10 | −5 |
| Base oil for lubricant oils 2 | Yield based on LF (%) | 25.4 | 24.9 | 15.3 | 24.6 |
| | 100° C. Kinematic viscosity ($mm^2/s$) | 4.25 | 4.18 | 4.37 | 4.36 |
| | Viscosity Index | 140 | 131 | 132 | 129 |
| | Pour point (° C.) | −22.5 | −22.5 | −20 | −25 |
| Base oil for lubricant oils 3 | Yield based on LF (%) | 16.4 | 6.3 | 9.9 | 15.9 |
| | 100° C. Kinematic viscosity ($mm^2/s$) | 6.32 | 6.58 | 6.49 | 6.63 |
| | Viscosity index | 146 | 142 | 146 | 145 |
| | Pour point (° C.) | −12.5 | −10 | 0 | −5 |
| Total yield 1 (ratio based on CF (RE + FF)) (%) | | 22.2 | 10.2 | 12.2 | 9.9 |
| Total yield 2 (ratio based on FE) (%) | | 31.2 | 23.8 | 15.9 | 41.2 |

TABLE 18

| | | Comparative Example b1 | Comparative Example b2 |
|---|---|---|---|
| Base oil for lubricant oils 1 | Yield based on LF (%) | 10.9 | 6.2 |
| | 100° C. Kinematic viscosity ($mm^2/s$) | 2.46 | 2.43 |
| | Viscosity index | 115 | 112 |
| | Pour point (° C.) | 5 | −15 |
| Base oil for lubricant oils 2 | Yield based on LF (%) | 23.1 | 13.1 |
| | 100° C. Kinematic viscosity ($mm^2/s$) | 4.28 | 4.46 |
| | Viscosity index | 118 | 128 |
| | Pour point (° C.) | −20 | −20 |
| Base oil for lubricant oils 3 | Yield based on LF (%) | 14.9 | 8.5 |
| | 100° C. Kinematic viscosity ($mm^2/s$) | 6.47 | 6.38 |
| | Viscosity index | 140 | 136 |
| | Pour point (° C.) | −10 | −30 |

TABLE 18-continued

| | Comparative Example b1 | Comparative Example b2 |
|---|---|---|
| Total yield 1 (ratio based on CF (RF + FF)) (%) | 6.5 | 9.9 |
| Total yield 2 (ratio based on FF) (%) | 36.2 | 11.6 |

REFERENCE SIGNS LIST

10 . . . First reactor, 20 . . . First separator, 21 . . . First vacuum distillation tower, 30 . . . Second reactor, 40 . . . Third reactor, 50 . . . Second separator, 51 . . . Second vacuum distillation tower, 60 . . . First gas-liquid separator, 70 . . . Second gas-liquid separator, 80 . . . Acid gas absorption tower, L1, L2, L3, L4, L4', L5, L6, L7, L8, L9, L10, L10', L11, L12, L13, L21, L22, L23, L24, L31, L32, L33, L34, L35, L36, L40 . . . Flow channels, 100 . . . Apparatus for producing a base oil for lubricant oils

The invention claimed is:

1. A method for producing a base oil for lubricant oils comprising:

a first step of hydrocracking, on a hydrocracking catalyst containing at least two metals selected from the group consisting of cobalt, molybdenum, nickel, and tungsten, a stock oil having a content percentage of sulfur of 0.001 to 3.0% by mass and a heavy matter having 30 or more carbon atoms of 80% by mass or more under a condition of a partial pressure of hydrogen of 5 to 20 MPa so that a crack per mass of the heavy matter is 20 to 85% by mass, to obtain a hydrocracked oil comprising the heavy matter and a hydrocracked product thereof, a second step of fractionating the hydrocracked oil into a base oil fraction comprising the hydrocracked product and a heavy fraction comprising the heavy matter and being heavier than the base oil fraction, a third step of isomerization dewaxing the base oil fraction from the fractionation in the second step to obtain a dewaxed oil, wherein the heavy fraction from the fractionation in the second step is returned to the first step as a part of the stock oil;

wherein the third step is a step of obtaining the dewaxed oil by allowing the base oil fraction to contact a hydroisomerization dewaxing catalyst, the hydroisomerization dewaxing catalyst containing a carrier comprising zeolite having a 10-membered ring one dimensional pore structure and a binder, and platinum and/or palladium supported on the carrier, and having a carbon content of 0.4 to 3.5% by mass, and the zeolite derived from an ion-exchanged zeolite obtained by ion exchanging an organic template-containing zeolite containing an organic template and having a 10-membered ring one dimensional pore structure in a solution comprising ammonium ion and/or proton.

2. The production method according to claim 1, wherein a content percentage of sulfur in the stock oil is 0.01 to 0.5% by mass.

3. The production method according to claim 1, further comprising:

a fourth step of obtaining a hydrorefined oil by hydrorefining the dewaxed oil obtained in the third step, and a fifth step of fractionating the hydrorefined oil obtained in the fourth step to obtain a base oil for lubricant oils.

4. The production method according to claim 3, comprising obtaining, in the fifth step, a base oil for lubricant oils having a kinematic viscosity at 100° C. of 3.5 $mm^2/s$ or more and 4.5 $mm^2/s$ or less and a viscosity index of 120 or more.

5. The production method according to claim 1, wherein the stock oil comprises a slack wax having a 10% by volume distillation temperature of 500 to 600° C. and a 90% by volume distillation temperature of 600 to 700° C., and the hydrocracking is carried out so that a crack per mass of the heavy matter in the first step is 25 to 85% by mass.

6. The production method according to claim 1, wherein the stock oil comprises a slack wax having a 10% by volume distillation temperature of 400 to 500° C. and a 90% by volume distillation temperature of 500 to 600° C., and the hydrocracking is carried out so that a crack per mass of the heavy matter in the first step is 20 to 80% by mass.

7. The production method according to claim 1, wherein the hydrocracking is carried out, in the presence of hydrogen, by allowing the stock oil to contact a hydrocracking catalyst containing a porous inorganic oxide composed of 2 or more elements selected from aluminium, silicon, zirconium, boron, titanium and magnesium and at least 1 metal selected from elements belonging to the Group 6 and the Groups 8 to 10 in the periodic table supported on the porous inorganic oxide.

8. The method for producing a base oil for lubricant oils according to claim 1, wherein the third step is a step of obtaining the dewaxed oil by allowing the base oil fraction to contact a hydroisomerization dewaxing catalyst, the hydroisomerization dewaxing catalyst containing a carrier comprising zeolite having a 10-membered ring one dimensional pore structure and a binder, and platinum and/or palladium supported on the carrier, and having a micro pore volume of 0.02 to 0.12 ml/g, the zeolite derived from an ion-exchanged zeolite obtained by ion exchanging an organic template-containing zeolite containing an organic template and having a 10-membered ring one dimensional pore structure in a solution comprising ammonium ion and/or proton, and having a micro pore volume per unit mass of 0.01 to 0.12 ml/g.

* * * * *